US009267347B2

(12) United States Patent
Agrawal et al.

(10) Patent No.: US 9,267,347 B2
(45) Date of Patent: Feb. 23, 2016

(54) DISSOLVABLE TOOL

(71) Applicants: Gaurav Agrawal, Aurora, CO (US); Zhiyue Xu, Cypress, TX (US)

(72) Inventors: Gaurav Agrawal, Aurora, CO (US); Zhiyue Xu, Cypress, TX (US)

(73) Assignee: Baker Huges Incorporated, Houston, TX (US)

( * ) Notice: Subject to any disclaimer, the term of this patent is extended or adjusted under 35 U.S.C. 154(b) by 0 days.

(21) Appl. No.: 13/772,104

(22) Filed: Feb. 20, 2013

(65) Prior Publication Data

US 2013/0160992 A1 Jun. 27, 2013

Related U.S. Application Data

(62) Division of application No. 12/633,662, filed on Dec. 8, 2009, now Pat. No. 8,403,037.

(51) Int. Cl.

| | |
|---|---|
| ***E21B 23/00*** | (2006.01) |
| ***E21B 41/00*** | (2006.01) |
| ***E21B 23/04*** | (2006.01) |

(52) U.S. Cl.

CPC ..... *E21B 23/04* (2013.01); *E21B 23/00* (2013.01); *E21B 41/00* (2013.01)

(58) Field of Classification Search

CPC ..... E21B 34/063; E21B 34/14; E21B 33/134; E21B 41/00; E21B 23/00; E21B 23/04

USPC ..... 166/300, 376, 193, 153; 156/247, 248, 156/701–719; 277/331, 316; 428/576, 559

See application file for complete search history.

(56) References Cited

U.S. PATENT DOCUMENTS

| | | | | |
|---|---|---|---|---|
| 1,468,905 | A | 9/1923 | Herman | |
| 2,238,895 | A | 4/1941 | Gage | |
| 2,294,648 | A | 9/1942 | Gerhard | |
| 2,301,624 | A | 11/1942 | Holt | |
| 2,754,910 | A | 7/1956 | Derrick et al. | |
| 3,057,405 | A | 10/1962 | Mallinger | |
| 3,196,949 | A | 7/1965 | Thomas | |
| 3,242,988 | A | 3/1966 | McGuire et al. | |
| 3,316,748 | A | 5/1967 | Lang et al. | |
| 3,347,317 | A | 10/1967 | Zandmer | |
| 3,347,714 | A | 10/1967 | Broverman et al. | |
| 3,395,758 | A | 8/1968 | Kelly et al. | |
| 3,434,537 | A | 3/1969 | Zandmer | |
| 3,465,181 | A | 9/1969 | Colby et al. | |
| 3,513,230 | A | 5/1970 | Rhees et al. | |
| 3,645,331 | A * | 2/1972 | Maurer et al. | 175/65 |

(Continued)

FOREIGN PATENT DOCUMENTS

| | | |
|---|---|---|
| CN | 1076968 | 10/1993 |
| CN | 1076968 A | 10/1993 |

(Continued)

OTHER PUBLICATIONS

Canadian Pat. App. No. 2783241 filed on Dec. 7, 2010 titled Nanomatrix Powder Metal Compact.

(Continued)

*Primary Examiner* — Daniel P Stephenson
(74) *Attorney, Agent, or Firm* — Cantor Colburn LLP

(57) ABSTRACT

A dissolvable tool includes a body having at least one stress riser configured to concentrate stress thereat to accelerate structural degradation of the body through chemical reaction under applied stress within a reactive environment.

19 Claims, 6 Drawing Sheets

(56) References Cited

U.S. PATENT DOCUMENTS 3,765,484 A 10/1973 Hamby, Jr. et al.
3,768,563 A 10/1973 Blount
3,878,889 A 4/1975 Seabourn
3,924,677 A 12/1975 Prenner et al.
4,039,717 A 8/1977 Titus
4,050,529 A 9/1977 Tagirov et al.
4,248,307 A 2/1981 Silberman et al.
4,372,384 A 2/1983 Kinney
4,373,584 A 2/1983 Silberman et al.
4,373,952 A 2/1983 Parent
4,374,543 A 2/1983 Richardson
4,384,616 A 5/1983 Dellinger
4,395,440 A 7/1983 Abe et al.
4,399,871 A 8/1983 Adkins et al.
4,407,368 A 10/1983 Erbstoesser
4,422,508 A 12/1983 Rutledge, Jr. et al.
4,452,311 A 6/1984 Speegle et al.
4,475,729 A 10/1984 Costigan
4,498,543 A 2/1985 Pye et al.
4,526,840 A 7/1985 Jerabek
4,534,414 A 8/1985 Pringle
4,554,986 A 11/1985 Jones
4,640,354 A 2/1987 Boisson
4,668,470 A 5/1987 Gilman et al.
4,674,572 A 6/1987 Gallus
4,678,037 A 7/1987 Smith
4,681,133 A 7/1987 Weston
4,688,641 A 8/1987 Knieriemen
4,703,807 A 11/1987 Weston
4,706,753 A 11/1987 Ohkochi et al.
4,708,202 A 11/1987 Sukup et al.
4,708,208 A 11/1987 Halbardier
4,709,761 A 12/1987 Setterberg, Jr.
4,714,116 A 12/1987 Brunner
4,721,159 A 1/1988 Ohkochi et al.
4,738,599 A 4/1988 Shilling
4,768,588 A 9/1988 Kupsa
4,775,598 A 10/1988 Jaeckel
4,784,226 A 11/1988 Wyatt
4,805,699 A 2/1989 Halbardier
4,817,725 A 4/1989 Jenkins
4,834,184 A 5/1989 Streich et al.
H635 H 6/1989 Johnson et al.
4,850,432 A 7/1989 Porter et al.
4,869,324 A 9/1989 Holder
4,869,325 A 9/1989 Halbardier
4,889,187 A 12/1989 Terrell et al.
4,890,675 A 1/1990 Dew
4,909,320 A 3/1990 Hebert et al.
4,932,474 A 6/1990 Schroeder, Jr. et al.
4,938,309 A 7/1990 Emdy
4,938,809 A 7/1990 Das et al.
4,944,351 A 7/1990 Eriksen et al.
4,949,788 A 8/1990 Szarka et al.
4,977,958 A 12/1990 Miller
4,981,177 A 1/1991 Carmody et al.
4,986,361 A 1/1991 Mueller et al.
4,997,622 A 3/1991 Regazzoni et al.
5,006,044 A 4/1991 Walker, Sr. et al.
5,010,955 A 4/1991 Springer
5,036,921 A 8/1991 Pittard et al.
5,048,611 A 9/1991 Cochran
5,049,165 A 9/1991 Tselesin
5,061,323 A 10/1991 DeLuccia
5,063,775 A 11/1991 Walker, Sr. et al.
5,073,207 A 12/1991 Faure et al.
5,074,361 A 12/1991 Brisco et al.
5,076,869 A 12/1991 Bourell et al.
5,087,304 A 2/1992 Chang et al.
5,090,480 A 2/1992 Pittard et al.
5,095,988 A 3/1992 Bode
5,103,911 A 4/1992 Heijnen
5,117,915 A 6/1992 Mueller et al.
5,161,614 A 11/1992 Wu et al.
5,171,734 A 12/1992 Sanjurjo et al.
5,178,216 A 1/1993 Giroux et al.
5,181,571 A 1/1993 Mueller et al.
5,183,631 A 2/1993 Kugimiya et al.
5,188,182 A 2/1993 Echols, III et al.
5,188,183 A 2/1993 Hopmann et al.
5,204,055 A 4/1993 Sachs et al.
5,222,867 A 6/1993 Walker, Sr. et al.
5,226,483 A 7/1993 Williamson, Jr.
5,228,518 A 7/1993 Wilson et al.
5,234,055 A 8/1993 Cornette
5,253,714 A 10/1993 Davis et al.
5,271,468 A 12/1993 Streich et al.
5,282,509 A 2/1994 Schurr, III
5,293,940 A 3/1994 Hromas et al.
5,304,260 A 4/1994 Aikawa et al.
5,304,588 A 4/1994 Boysen et al.
5,310,000 A 5/1994 Arterbury et al.
5,316,598 A 5/1994 Chang et al.
5,318,746 A 6/1994 Lashmore et al.
5,387,380 A 2/1995 Cima et al.
5,392,860 A 2/1995 Ross
5,394,941 A 3/1995 Venditto et al.
5,398,754 A 3/1995 Dinhoble
5,407,011 A 4/1995 Layton
5,409,555 A 4/1995 Fujita et al.
5,411,082 A 5/1995 Kennedy
5,417,285 A 5/1995 Van Buskirk et al.
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,456,317 A 10/1995 Hood, III et al.
5,464,062 A 11/1995 Blizzard, Jr.
5,472,048 A 12/1995 Kennedy et al.
5,474,131 A 12/1995 Jordan, Jr. et al.
5,477,923 A 12/1995 Jordan, Jr. et al.
5,479,986 A * 1/1996 Gano et al. ..... 166/292
5,507,439 A 4/1996 Story
5,526,880 A 6/1996 Jordan, Jr. et al.
5,526,881 A 6/1996 Martin et al.
5,533,573 A 7/1996 Jordan, Jr. et al.
5,558,153 A 9/1996 Holcombe et al.
5,607,017 A 3/1997 Owens et al.
5,623,993 A 4/1997 Van Buskirk et al.
5,623,994 A 4/1997 Robinson
5,636,691 A 6/1997 Hendrickson et al.
5,641,023 A 6/1997 Ross et al.
5,647,444 A 7/1997 Williams
5,665,289 A 9/1997 Chung et al.
5,677,372 A 10/1997 Yamamoto et al.
5,685,372 A 11/1997 Gano
5,701,576 A 12/1997 Fujita et al.
5,707,214 A 1/1998 Schmidt
5,709,269 A 1/1998 Head
5,720,344 A 2/1998 Newman
5,728,195 A 3/1998 Eastman et al.
5,765,639 A 6/1998 Muth
5,782,305 A 7/1998 Hicks
5,797,454 A 8/1998 Hipp
5,826,652 A 10/1998 Tapp
5,826,661 A 10/1998 Parker et al.
5,836,396 A 11/1998 Norman
5,857,521 A 1/1999 Ross et al.
5,881,816 A 3/1999 Wright
5,896,819 A 4/1999 Turila et al.
5,902,424 A 5/1999 Fujita et al.
5,934,372 A 8/1999 Muth
5,941,309 A * 8/1999 Appleton ..... 166/317
5,960,881 A 10/1999 Allamon et al.
5,990,051 A 11/1999 Ischy et al.
5,992,452 A 11/1999 Nelson, II
5,992,520 A 11/1999 Schultz et al.
6,007,314 A 12/1999 Nelson, II
6,024,915 A 2/2000 Kume et al.
6,032,735 A 3/2000 Echols
6,036,777 A 3/2000 Sachs
6,047,773 A 4/2000 Zeltmann et al.
6,050,340 A 4/2000 Scott
6,076,600 A 6/2000 Vick, Jr. et al.

(56) References Cited

U.S. PATENT DOCUMENTS 6,079,496 A 6/2000 Hirth
6,085,837 A 7/2000 Massinon et al.
6,095,247 A 8/2000 Streich et al.
6,119,783 A 9/2000 Parker et al.
6,142,237 A 11/2000 Christmas et al.
6,161,622 A 12/2000 Robb et al.
6,167,970 B1 1/2001 Stout et al.
6,170,583 B1 1/2001 Boyce
6,173,779 B1 1/2001 Smith
6,189,616 B1 2/2001 Gano et al.
6,189,618 B1 * 2/2001 Beeman et al. ..... 166/312
6,213,202 B1 4/2001 Read, Jr.
6,220,350 B1 4/2001 Brothers et al.
6,220,357 B1 4/2001 Carmichael et al.
6,237,688 B1 5/2001 Burleson et al.
6,241,021 B1 6/2001 Bowling
6,248,399 B1 6/2001 Hehmann
6,250,392 B1 6/2001 Muth
6,273,187 B1 8/2001 Voisin, Jr. et al.
6,276,452 B1 8/2001 Davis et al.
6,276,457 B1 8/2001 Moffatt et al.
6,279,656 B1 8/2001 Sinclair et al.
6,302,205 B1 10/2001 Ryll
6,315,041 B1 11/2001 Carlisle et al.
6,315,050 B2 11/2001 Vaynshteyn et al.
6,325,148 B1 12/2001 Trahan et al.
6,328,110 B1 12/2001 Joubert
6,341,653 B1 1/2002 Firmaniuk et al.
6,349,766 B1 2/2002 Bussear et al.
6,354,379 B2 3/2002 Miszewski et al.
6,357,322 B1 3/2002 Dolan et al.
6,357,332 B1 3/2002 Vecchio
6,371,206 B1 4/2002 Mills
6,372,346 B1 4/2002 Toth
6,382,244 B2 5/2002 Vann
6,390,195 B1 5/2002 Nguyen et al.
6,390,200 B1 5/2002 Allamon et al.
6,394,185 B1 5/2002 Constien
6,397,950 B1 6/2002 Streich et al.
6,408,946 B1 6/2002 Marshall et al.
6,419,023 B1 7/2002 George et al.
6,439,313 B1 8/2002 Thomeer et al.
6,457,525 B1 10/2002 Scott
6,467,546 B2 10/2002 Allamon et al.
6,470,965 B1 10/2002 Winzer
6,491,116 B2 12/2002 Berscheidt et al.
6,513,598 B2 2/2003 Moore et al.
6,540,033 B1 4/2003 Sullivan et al.
6,543,543 B2 4/2003 Muth
6,561,275 B2 5/2003 Glass et al.
6,588,507 B2 7/2003 Dusterhoft et al.
6,591,915 B2 7/2003 Burris et al.
6,601,648 B2 8/2003 Ebinger
6,601,650 B2 8/2003 Sundararajan
6,609,569 B2 8/2003 Howlett et al.
6,619,400 B2 9/2003 Brunet
6,634,428 B2 10/2003 Krauss et al.
6,662,886 B2 12/2003 Russell
6,675,889 B1 1/2004 Mullins et al.
6,699,305 B2 3/2004 Myrick
6,715,541 B2 4/2004 Pedersen et al.
6,719,051 B2 4/2004 Hailey, Jr. et al.
6,755,249 B2 6/2004 Robison et al.
6,776,228 B2 8/2004 Pedersen et al.
6,779,599 B2 8/2004 Mullins et al.
6,799,638 B2 10/2004 Butterfield, Jr.
6,810,960 B2 11/2004 Pia
6,817,414 B2 11/2004 Lee
6,831,044 B2 12/2004 Constien
6,883,611 B2 4/2005 Smith et al.
6,896,049 B2 5/2005 Moyes
6,896,061 B2 5/2005 Hriscu et al.
6,899,176 B2 5/2005 Hailey, Jr. et al.
6,899,777 B2 5/2005 Vaidyanathan et al.
6,908,516 B2 6/2005 Hehmann et al.
6,926,086 B2 8/2005 Patterson et al.
6,932,159 B2 8/2005 Hovem
6,945,331 B2 9/2005 Patel
6,951,331 B2 10/2005 Haughom et al.
6,959,759 B2 11/2005 Doane et al.
6,973,970 B2 12/2005 Johnston et al.
6,973,973 B2 12/2005 Howard et al.
6,983,796 B2 1/2006 Bayne et al.
6,986,390 B2 1/2006 Doane et al.
7,013,989 B2 3/2006 Hammond et al.
7,017,664 B2 3/2006 Walker et al.
7,021,389 B2 4/2006 Bishop et al.
7,025,146 B2 4/2006 King et al.
7,028,778 B2 4/2006 Krywitsky
7,044,230 B2 5/2006 Starr et al.
7,049,272 B2 5/2006 Sinclair et al.
7,051,805 B2 5/2006 Doane et al.
7,059,410 B2 6/2006 Bousche et al.
7,090,027 B1 8/2006 Williams
7,093,664 B2 8/2006 Todd et al.
7,096,945 B2 8/2006 Richards et al.
7,096,946 B2 8/2006 Jasser et al.
7,097,906 B2 8/2006 Gardner
7,108,080 B2 9/2006 Tessari et al.
7,111,682 B2 9/2006 Blaisdell
7,141,207 B2 11/2006 Jandeska, Jr. et al.
7,150,326 B2 12/2006 Bishop et al.
7,163,066 B2 1/2007 Lehr
7,174,963 B2 2/2007 Bertelsen
7,182,135 B2 2/2007 Szarka
7,188,559 B1 3/2007 Vecchio
7,210,527 B2 5/2007 Walker et al.
7,210,533 B2 5/2007 Starr et al.
7,217,311 B2 5/2007 Hong et al.
7,234,530 B2 6/2007 Gass
7,252,162 B2 8/2007 Akinlade et al.
7,255,172 B2 8/2007 Johnson
7,255,178 B2 8/2007 Slup et al.
7,264,060 B2 9/2007 Wills
7,267,172 B2 9/2007 Hofman
7,267,178 B2 9/2007 Krywitsky
7,270,186 B2 9/2007 Johnson
7,287,592 B2 10/2007 Surjaatmadja et al.
7,311,152 B2 12/2007 Howard et al.
7,316,274 B2 1/2008 Xu et al.
7,320,365 B2 1/2008 Pia
7,322,412 B2 1/2008 Badalamenti et al.
7,325,617 B2 2/2008 Murray
7,328,750 B2 2/2008 Swor et al.
7,331,388 B2 2/2008 Vilela et al.
7,337,854 B2 3/2008 Horn et al.
7,346,456 B2 3/2008 Le Bemadjiel
7,353,879 B2 4/2008 Todd et al.
7,360,593 B2 4/2008 Constien
7,360,597 B2 4/2008 Blaisdell
7,384,443 B2 6/2008 Mirchandani
7,387,158 B2 6/2008 Murray et al.
7,387,165 B2 6/2008 Lopez de Cardenas et al.
7,392,841 B2 7/2008 Murray et al.
7,422,058 B2 9/2008 O'Malley
7,426,964 B2 9/2008 Lynde et al.
7,445,049 B2 11/2008 Howard et al.
7,451,815 B2 11/2008 Hailey, Jr.
7,451,817 B2 11/2008 Reddy et al.
7,461,699 B2 12/2008 Richard et al.
7,464,764 B2 12/2008 Xu
7,472,750 B2 1/2009 Walker et al.
7,478,676 B2 1/2009 East, Jr. et al.
7,503,390 B2 3/2009 Gomez
7,503,399 B2 3/2009 Badalamenti et al.
7,510,018 B2 3/2009 Williamson et al.
7,513,311 B2 4/2009 Gramstad et al.
7,527,103 B2 5/2009 Huang et al.
7,537,825 B1 5/2009 Wardle et al.
7,552,777 B2 6/2009 Murray et al.
7,552,779 B2 6/2009 Murray
7,575,062 B2 8/2009 East, Jr.
7,591,318 B2 9/2009 Tilghman
7,600,572 B2 10/2009 Slup et al.

(56) References Cited

U.S. PATENT DOCUMENTS 7,604,055 B2 10/2009 Richard et al.
7,617,871 B2 11/2009 Surjaatmadja et al.
7,635,023 B2 12/2009 Goldberg et al.
7,640,988 B2 1/2010 Phi et al.
7,661,480 B2 2/2010 Al-Anazi
7,661,481 B2 2/2010 Todd et al.
7,665,537 B2 2/2010 Patel et al.
7,686,082 B2 3/2010 Marsh
7,690,436 B2 4/2010 Turley et al.
7,699,101 B2 4/2010 Fripp et al.
7,703,510 B2 4/2010 Xu
7,703,511 B2 4/2010 Buyers et al.
7,708,078 B2 5/2010 Stoesz
7,709,421 B2 5/2010 Jones et al.
7,712,541 B2 5/2010 Loretz et al.
7,726,406 B2 6/2010 Xu
7,735,578 B2 6/2010 Loehr et al.
7,752,971 B2 7/2010 Loehr
7,757,773 B2 7/2010 Rytlewski
7,762,342 B2 7/2010 Richard et al.
7,770,652 B2 8/2010 Barnett
7,775,284 B2 8/2010 Richards et al.
7,775,285 B2 8/2010 Surjaatmadja et al.
7,775,286 B2 * 8/2010 Duphorne ..... 166/376
7,784,543 B2 8/2010 Johnson
7,793,714 B2 9/2010 Johnson
7,798,225 B2 9/2010 Giroux et al.
7,798,226 B2 9/2010 Themig
7,798,236 B2 9/2010 McKeachnie et al.
7,806,189 B2 10/2010 Frazier
7,806,192 B2 10/2010 Foster et al.
7,810,553 B2 10/2010 Cruickshank et al.
7,810,567 B2 10/2010 Daniels et al.
7,819,198 B2 10/2010 Birckhead et al.
7,828,055 B2 11/2010 Willauer et al.
7,833,944 B2 11/2010 Munoz et al.
7,849,927 B2 12/2010 Herrera
7,851,016 B2 12/2010 Arbab et al.
7,855,168 B2 12/2010 Fuller et al.
7,861,779 B2 1/2011 Vestavik
7,861,781 B2 1/2011 D'Arcy
7,874,365 B2 1/2011 East, Jr. et al.
7,878,253 B2 2/2011 Stowe et al.
7,896,091 B2 3/2011 Williamson et al.
7,897,063 B1 3/2011 Perry et al.
7,900,696 B1 3/2011 Nish et al.
7,900,703 B2 3/2011 Clark et al.
7,909,096 B2 3/2011 Clark et al.
7,909,104 B2 3/2011 Bjørgum
7,909,110 B2 3/2011 Sharma et al.
7,909,115 B2 3/2011 Grove et al.
7,913,765 B2 3/2011 Crow et al.
7,918,275 B2 4/2011 Clem
7,931,093 B2 4/2011 Foster et al.
7,938,191 B2 5/2011 Vaidya
7,946,335 B2 5/2011 Bewlay et al.
7,946,340 B2 5/2011 Surjaatmadja et al.
7,958,940 B2 6/2011 Jameson
7,963,331 B2 6/2011 Surjaatmadja et al.
7,963,340 B2 6/2011 Gramstad et al.
7,963,342 B2 6/2011 George
7,980,300 B2 7/2011 Roberts et al.
7,987,906 B1 8/2011 Troy
7,992,763 B2 8/2011 Vecchio et al.
8,020,619 B1 9/2011 Robertson et al.
8,020,620 B2 9/2011 Daniels et al.
8,025,104 B2 9/2011 Cooke, Jr.
8,028,767 B2 10/2011 Radford et al.
8,033,331 B2 10/2011 Themig
8,039,422 B1 10/2011 Al-Zahrani
8,056,628 B2 11/2011 Whitsitt et al.
8,056,638 B2 11/2011 Clayton et al.
8,109,340 B2 2/2012 Doane et al.
8,127,856 B1 3/2012 Nish et al.
8,153,052 B2 4/2012 Jackson et al.
8,163,060 B2 4/2012 Imanishi et al.
8,211,247 B2 7/2012 Marya et al.
8,211,248 B2 7/2012 Marya
8,226,740 B2 7/2012 Chaumonnot et al.
8,230,731 B2 7/2012 Dyer et al.
8,231,947 B2 7/2012 Vaidya et al.
8,263,178 B2 9/2012 Boulos et al.
8,276,670 B2 10/2012 Patel
8,277,974 B2 10/2012 Kumar et al.
8,297,364 B2 10/2012 Agrawal et al.
8,327,931 B2 12/2012 Agrawal et al.
8,403,037 B2 3/2013 Agrawal et al.
8,425,651 B2 4/2013 Xu et al.
8,956,660 B2 2/2015 Launag et al.
9,079,246 B2 7/2015 Xu et al.
2001/0045285 A1 11/2001 Russell
2001/0045288 A1 11/2001 Allamon et al.
2002/0000319 A1 1/2002 Brunet
2002/0007948 A1 1/2002 Bayne et al.
2002/0014268 A1 2/2002 Vann
2002/0066572 A1 6/2002 Muth
2002/0162661 A1 11/2002 Krauss et al.
2003/0037925 A1 2/2003 Walker et al.
2003/0060374 A1 3/2003 Cooke, Jr.
2003/0075326 A1 4/2003 Ebinger
2003/0104147 A1 6/2003 Bretschneider et al.
2003/0127013 A1 7/2003 Zavitsanos et al.
2003/0141060 A1 7/2003 Hailey, Jr. et al.
2003/0141061 A1 7/2003 Hailey, Jr. et al.
2003/0141079 A1 7/2003 Doane et al.
2003/0155114 A1 8/2003 Pedersen et al.
2003/0155115 A1 8/2003 Pedersen et al.
2003/0159828 A1 8/2003 Howard et al.
2003/0164237 A1 9/2003 Butterfield
2003/0183391 A1 10/2003 Hriscu et al.
2004/0020832 A1 2/2004 Richards et al.
2004/0031605 A1 2/2004 Mickey
2004/0045723 A1 3/2004 Slup et al.
2004/0055758 A1 3/2004 Brezinski et al.
2004/0058167 A1 3/2004 Arbab et al.
2004/0089449 A1 * 5/2004 Walton et al. ..... 166/297
2004/0154806 A1 8/2004 Bode et al.
2004/0159428 A1 8/2004 Hammond et al.
2004/0182583 A1 9/2004 Doane et al.
2004/0256109 A1 12/2004 Johnson
2004/0256157 A1 12/2004 Tessari et al.
2004/0261993 A1 12/2004 Nguyen
2005/0034876 A1 2/2005 Doane et al.
2005/0051329 A1 3/2005 Blaisdell
2005/0064247 A1 3/2005 Sane et al.
2005/0069449 A1 3/2005 Jackson et al.
2005/0106316 A1 5/2005 Rigney et al.
2005/0126334 A1 6/2005 Mirchandani
2005/0199401 A1 9/2005 Patel et al.
2005/0205266 A1 9/2005 Todd et al.
2005/0241824 A1 11/2005 Burris et al.
2005/0241825 A1 11/2005 Burris et al.
2005/0257936 A1 11/2005 Lehr
2005/0279501 A1 12/2005 Surjaatmadja et al.
2006/0081378 A1 4/2006 Howard et al.
2006/0102871 A1 5/2006 Wang et al.
2006/0108114 A1 5/2006 Johnson et al.
2006/0108126 A1 5/2006 Horn et al.
2006/0124310 A1 6/2006 Lopez de Cardenas et al.
2006/0124312 A1 6/2006 Rytlewski et al.
2006/0131011 A1 6/2006 Lynde et al.
2006/0150770 A1 7/2006 Freim et al.
2006/0151178 A1 7/2006 Howard et al.
2006/0162927 A1 7/2006 Walker et al.
2006/0169453 A1 8/2006 Savery et al.
2006/0207763 A1 9/2006 Hofman
2006/0213670 A1 9/2006 Bishop et al.
2006/0231253 A1 10/2006 Vilela et al.
2006/0283592 A1 12/2006 Sierra et al.
2007/0017674 A1 1/2007 Blaisdell
2007/0017675 A1 1/2007 Hammami et al.
2007/0029082 A1 2/2007 Giroux et al.
2007/0039741 A1 2/2007 Hailey
2007/0044966 A1 3/2007 Davies et al.

(56) References Cited

U.S. PATENT DOCUMENTS

2007/0051521 A1 3/2007 Fike et al.
2007/0053785 A1 3/2007 Hetz et al.
2007/0054101 A1 3/2007 Sigalas et al.
2007/0074601 A1 4/2007 Hong et al.
2007/0107899 A1 5/2007 Werner et al.
2007/0107908 A1* 5/2007 Vaidya et al. ..... 166/376
2007/0119600 A1 5/2007 Slup et al.
2007/0151769 A1 7/2007 Slutz et al.
2007/0181224 A1* 8/2007 Marya et al. ..... 148/400
2007/0185655 A1 8/2007 Le Bemadjiel
2007/0187095 A1 8/2007 Walker et al.
2007/0221373 A1* 9/2007 Murray ..... 166/192
2007/0221384 A1 9/2007 Murray
2007/0272411 A1 11/2007 Lopez De Cardenas et al.
2007/0272413 A1 11/2007 Rytlewski et al.
2007/0277979 A1 12/2007 Todd et al.
2007/0284109 A1 12/2007 East et al.
2007/0284112 A1 12/2007 Magne et al.
2007/0299510 A1 12/2007 Venkatraman et al.
2008/0011473 A1 1/2008 Wood et al.
2008/0060810 A9 3/2008 Nguyen et al.
2008/0066923 A1 3/2008 Xu
2008/0066924 A1 3/2008 Xu
2008/0072705 A1 3/2008 Chaumonnot et al.
2008/0078553 A1 4/2008 George
2008/0099209 A1 5/2008 Loretz et al.
2008/0115932 A1 5/2008 Cooke
2008/0121390 A1 5/2008 O'Malley et al.
2008/0135249 A1 6/2008 Fripp et al.
2008/0149325 A1 6/2008 Crawford
2008/0149345 A1 6/2008 Marya et al.
2008/0169105 A1 7/2008 Williamson et al.
2008/0179060 A1 7/2008 Surjaatmadja et al.
2008/0179104 A1 7/2008 Zhang et al.
2008/0202764 A1 8/2008 Clayton et al.
2008/0210473 A1 9/2008 Zhang et al.
2008/0216383 A1 9/2008 Pierick et al.
2008/0223586 A1 9/2008 Barnett
2008/0223587 A1 9/2008 Cherewyk
2008/0236829 A1 10/2008 Lynde
2008/0248413 A1 10/2008 Ishii et al.
2008/0277109 A1 11/2008 Vaidya
2008/0277980 A1 11/2008 Koda et al.
2008/0282924 A1 11/2008 Saenger et al.
2008/0314581 A1 12/2008 Brown
2009/0050334 A1 2/2009 Marya et al.
2009/0056934 A1 3/2009 Xu
2009/0065216 A1 3/2009 Frazier
2009/0084553 A1 4/2009 Rytlewski et al.
2009/0084556 A1 4/2009 Richards et al.
2009/0090440 A1 4/2009 Kellett et al.
2009/0107684 A1 4/2009 Cooke, Jr.
2009/0114381 A1 5/2009 Stroobants
2009/0114382 A1 5/2009 Grove et al.
2009/0145666 A1 6/2009 Radford et al.
2009/0151949 A1 6/2009 Marya et al.
2009/0155616 A1 6/2009 Thamida et al.
2009/0159289 A1* 6/2009 Avant et al. ..... 166/316
2009/0178808 A1 7/2009 Williamson et al.
2009/0194273 A1 8/2009 Surjaatmadja et al.
2009/0205841 A1 8/2009 Kluge et al.
2009/0226704 A1 9/2009 Kauppinen et al.
2009/0242202 A1 10/2009 Rispler et al.
2009/0242208 A1 10/2009 Bolding
2009/0242214 A1 10/2009 Foster et al.
2009/0255684 A1 10/2009 Bolding
2009/0255686 A1 10/2009 Richard et al.
2009/0260817 A1 10/2009 Gambier et al.
2009/0266548 A1 10/2009 Olsen et al.
2009/0272544 A1 11/2009 Giroux et al.
2009/0283270 A1 11/2009 Langeslag
2009/0293672 A1 12/2009 Mirchandani et al.
2009/0301730 A1 12/2009 Gweily
2009/0305131 A1 12/2009 Kumar et al.
2009/0308588 A1 12/2009 Howell et al.
2010/0003536 A1 1/2010 Smith et al.
2010/0015469 A1 1/2010 Romanowski et al.
2010/0032151 A1 2/2010 Duphorne
2010/0038595 A1 2/2010 Imholt et al.
2010/0040180 A1 2/2010 Kim et al.
2010/0044041 A1 2/2010 Smith et al.
2010/0051278 A1 3/2010 Mytopher et al.
2010/0055491 A1 3/2010 Vecchio et al.
2010/0055492 A1 3/2010 Barsoum et al.
2010/0089583 A1 4/2010 Xu et al.
2010/0089587 A1 4/2010 Stout
2010/0101803 A1 4/2010 Clayton et al.
2010/0122817 A1 5/2010 Surjaatmadja et al.
2010/0139930 A1 6/2010 Patel et al.
2010/0200230 A1 8/2010 East, Jr. et al.
2010/0236793 A1 9/2010 Bjorgum
2010/0236794 A1 9/2010 Duan et al.
2010/0243254 A1 9/2010 Murphy et al.
2010/0252273 A1 10/2010 Duphorne
2010/0252280 A1 10/2010 Swor et al.
2010/0270031 A1 10/2010 Patel
2010/0276136 A1 11/2010 Evans et al.
2010/0282338 A1 11/2010 Gerrard et al.
2010/0282469 A1 11/2010 Richard et al.
2010/0294510 A1* 11/2010 Holmes ..... 166/376
2010/0319870 A1 12/2010 Bewlay et al.
2011/0005773 A1 1/2011 Dusterhoft et al.
2011/0036592 A1 2/2011 Fay
2011/0048743 A1 3/2011 Stafford et al.
2011/0052805 A1 3/2011 Bordere et al.
2011/0056692 A1 3/2011 Lopez De Cardenas et al.
2011/0067872 A1 3/2011 Agrawal
2011/0067889 A1 3/2011 Marya et al.
2011/0067890 A1 3/2011 Themig
2011/0094406 A1 4/2011 Marya et al.
2011/0100643 A1 5/2011 Themig et al.
2011/0127044 A1 6/2011 Radford et al.
2011/0132619 A1* 6/2011 Agrawal et al. ..... 166/376
2011/0132620 A1* 6/2011 Agrawal et al. ..... 166/376
2011/0132621 A1 6/2011 Agrawal et al.
2011/0135953 A1 6/2011 Xu et al.
2011/0139465 A1 6/2011 Tibbles et al.
2011/0147014 A1 6/2011 Chen et al.
2011/0186306 A1 8/2011 Marya et al.
2011/0214881 A1 9/2011 Newton et al.
2011/0247833 A1 10/2011 Todd et al.
2011/0253387 A1 10/2011 Ervin
2011/0256356 A1 10/2011 Tomantschger et al.
2011/0259610 A1 10/2011 Shkurti et al.
2011/0277987 A1 11/2011 Frazier
2011/0277989 A1 11/2011 Frazier
2011/0284232 A1 11/2011 Huang
2011/0284240 A1 11/2011 Chen et al.
2011/0284243 A1 11/2011 Frazier
2011/0300403 A1 12/2011 Vecchio et al.
2012/0067426 A1 3/2012 Soni et al.
2012/0103135 A1 5/2012 Xu et al.
2012/0107590 A1 5/2012 Xu et al.
2012/0118583 A1 5/2012 Johnson et al.
2012/0130470 A1* 5/2012 Agnew et al. ..... 623/1.11
2012/0145389 A1 6/2012 Fitzpatrick, Jr.
2012/0168152 A1 7/2012 Casciaro
2012/0211239 A1 8/2012 Kritzler et al.
2012/0267101 A1 10/2012 Cooke
2012/0292053 A1* 11/2012 Xu et al. ..... 166/387
2012/0318513 A1 12/2012 Mazyar et al.
2013/0004847 A1 1/2013 Kumar et al.
2013/0025409 A1 1/2013 Xu
2013/0032357 A1 2/2013 Mazyar et al.
2013/0048304 A1 2/2013 Agrawal et al.
2013/0052472 A1 2/2013 Xu
2013/0081814 A1 4/2013 Gaudette et al.
2013/0105159 A1 5/2013 Alvarez et al.
2013/0126190 A1 5/2013 Mazyar et al.
2013/0133897 A1 5/2013 Baihly et al.
2013/0146144 A1 6/2013 Joseph et al.
2013/0146302 A1 6/2013 Gaudette et al.
2013/0186626 A1 7/2013 Aitken et al.

(56) References Cited

U.S. PATENT DOCUMENTS

| | | | |
|---|---|---|---|
| 2013/0240203 | A1 | 9/2013 | Frazier |
| 2013/0327540 | A1 | 12/2013 | Hamid et al. |
| 2014/0116711 | A1 | 5/2014 | Tang |

FOREIGN PATENT DOCUMENTS

| | | | |
|---|---|---|---|
| CN | 1079234 | A | 12/1993 |
| CN | 1255879 | A | 6/2000 |
| CN | 1668545 | A | 9/2005 |
| CN | 101050417 | A | 10/2007 |
| CN | 101351523 | A | 1/2009 |
| CN | 101454074 | A | 6/2009 |
| CN | 101457321 | B | 6/2009 |
| EP | 0033625 | A1 | 8/1981 |
| EP | 1798301 | A1 | 8/2006 |
| EP | 1857570 | A2 | 11/2007 |
| JP | 7-54008 | | 2/1995 |
| JP | 08232029 | | 9/1996 |
| JP | 2010502840 | A | 1/2010 |
| KR | 95-0014350 | | 11/1995 |
| WO | 9947726 | | 9/1999 |
| WO | 2008034042 | A3 | 3/2008 |
| WO | 2008079485 | A2 | 7/2008 |
| WO | 2008079777 | A3 | 7/2008 |
| WO | 2009079745 | A1 | 7/2009 |
| WO | 2011071902 | A3 | 6/2011 |
| WO | 2011071910 | A2 | 6/2011 |
| WO | 2011071910 | A3 | 6/2011 |
| WO | 2012174101 | A2 | 12/2012 |
| WO | 2013053057 | A1 | 4/2013 |
| WO | 2013078031 | A1 | 5/2013 |

OTHER PUBLICATIONS

Canadian Pat. App. No. 2783346 filed on Dec. 7, 2010, published on Jun. 16, 2011 for "Engineered Powder Compact Composite Material".

Constantine, Jesse. "Selective Production of Horizontal Openhole Completions Using ECP and Sliding Sleeve Technology." SPE Rocky Mountain Regional Meeting, May 15-18, 1999, Gillette, Wyoming. [Abstract Only].

Elsayed Ayman, !mai Hisashi, Umeda Junko and Kondoh Katsuyoshi, "Effect of Consolidation and Extrusion Temperatures on Tensile Properties of Hot Extruded ZK61 Magnesium Alloy Gas Atomized Powders via Spark Plasma Sintering" Transacation of JWRI, vol. 38, (2009) No. 2, pp. 31-35.

H. Watarai, Trend of research and development for magnesium alloys-reducing the weight of structural materials in motor vehicles, (2006) Science and technology trends, Quaterly review No. 18, 84-97.

Bing Q. Han, Enrique J. Lavernia and Farghalli A. Mohamed, "Mechanical Properties of Nanostructured Materials", Rev. Adv. Mater. Sci. 9(2005) 1-16.

International Search Report and Written Opinion, PCT/US2012/046231, Date of Mailing Jan. 29, 2013, Korean Intellectual Property Office, Written Opinion 6 pages, International Search Report 3 pages.

M. Bououdina, Z. X. Guo, Comparative study of mechanical alloying of (Mg+Al) and (Mg+Al+Ni) mixtures for hydrogen storage, J. Alloys, Compds, 2002, 336, 222-231.

M.Liu, P.J. Uggowitzer, A.V. Nagasekhar, P. Schmutz, M. Easton, G.L. Song, A. Atrens, Calculated phase diagrams and the corrosion of die-cast Mg-Al alloys, Corrosion Science, 2009, 51, 606-619.

Adam J. Maisano, "Cryomilling of Aluminum-Based and Magnesium-Based Metal Powders", Thesis, Virginia Tech, Jan. 13, 2006.

E.J. Lavenia, B.Q. Han, J.M. Schoenung: "Cryomilled nanostructured materials: Processing and properties", Materials Science and Engineering A, 493, (2008) 207-214.

International Search Report and Written Opinion; International Application No. PCT/US2012/038622; International Filing Date: May 18, 2012; Date of Mailing Dec. 6, 2012; 12 pages.

International Search Report and Written Opinion; International Application No. PCT/US2010/057763; International Filing date Nov. 23, 2010; Korean Intellectual Property Office; International Search Report 7 pages; Written Opinion 3 pages.

International Search Report and Written Opinion; PCT/US2010/059257; Korean Intellectual Property Office; dated Jul. 27, 2011.

Notification of Transmittal of the International Search Report and the Written Opinion of the International Searching Authority; PCT/US2010/059259; International Searching Authority KIPO; Mailed Jun. 13, 2011.

International Search Report and Written Opinion, PCT/US2010/059263, dated Jul. 8, 2011.

Notification of Transmittal of the International Search Report and the Written Opinion of the International Searching Authority; PCT/US2010/059265; International Searching Authority KIPO; Mailed Jun. 16, 2011.

Notification of Transmittal of the International Search Report and the Written Opinion of the International Searching Authority; PCT/US2010/059268; International Searching Authority KIPO; Mailed Jun. 17, 2011.

Notification of Transmittal of the International Search Report and the Written Opinion of the International Searching Authority, or the Declaration mailed on Feb. 23, 2012 (Dated Feb. 22, 2012) for PCT/US2011/043036.

Notification of Transmittal of the International Search Report and the Written Opinion of the International Searching Authority; PCT/US2011/047000; Korean Intellectual Property Office; Mailed Dec. 26, 2011; 8 pages.

International Search Report and Written Opinion of the International Searching Authority for International Application No. PCT/US2011/058099 (filed on Oct. 27, 2011), mailed on May 11, 2012.

International Search Report and Written Opinion of the International Searching Authority, or the Declaration for PCT/US2011/058105 mailed from the Korean Intellectual Property Office on May 1, 2012.

International Search Report and Written Opinion for International application No. PCT/US2012/034973 filed on Apr. 25, 2012, mailed on Nov. 29, 2012.

Patent Cooperation Treaty International Search Report and Written Opinion for International Patent Application No. PCT/US2012/034978 filed on Apr. 25, 2012, mailed on Nov. 12, 2012.

International Search Report and Written Opinion; PCT/US2012/038622; Dated Dec. 6, 2012; 12 pages.

S.L. Lee, C.W. Hsu, F.K. Hsu, C.Y. Chou, C.k. Lin, C.W. Weng, Effects of Ni addition on hydrogen storage properties of Mg17AL12alloy, Materials Chemistry and Physics, 2011, 126, 319-324.

Shumbera et al. "Improved Water Injector Performance in a Gulf of Mexico Deepwater Development Using an Openhole Frac Pack Completion and Downhole Filter System: Case History." SPE Annual Technical Conference and Exhibition, Oct. 5-8, 2003, Denver, Colorado. [Abstract Only].

T.J. Bastow, S. Celotto, Clustering and formation of nano-precipitates in dilute aluminum and magnesium alloys, Materials science and Engineering, 2003, C23, 757-762.

Vickery, Harold and Christian Bayne, "New One-Trip Multi-Zone Frac Pack System with Positive Positioning." European Petroleum Conference, Oct. 29-31, 2002, Aberdeen, UK. [Abstract Only].

H. Watanabe, T. Mukai, M. Mabuchi and K. Higashi, "Superplastic Deformation Mechanism in Powder Metallurgy Magnesium Alloys and Composites", Acta mater. 49 (2001) pp. 2027-2037.

Canadian Office Action dated Feb. 15, 2013 for Canadian Pat. App. No. 2,783,547 titled Coated Metallic Powder and Method of Making.

Chinese Office Action for related CN Application No. 201180052095.6, dated Jul. 21, 2014, pp. 1-32.

G. Song, "Recent Progress in Corrosion and Protection of Magnesium Alloys", Advanced Engineering Materials, 7(7), pp. 563-586, (2005).

Garfield G., Baker Hughes Incoporated, New One-Trip Sand-Control Completion System that Eliminates Formation Damage Resulting From conventional Perforating and Gravel-Packing Operations:, SPE Annual Technical Conference and Exhibition, Oct. 9-12, 2005.

Garfield, Garry, McElfresh, P., Williams C. and Baker Hughes Incorporated, "Maximizing Inflow Performance in Soft Sand Completions

(56) References Cited

OTHER PUBLICATIONS

Using New One-trip Sand Control Liner Completion Technology", SPE European Formation Damage Conference, May 25-27, 2005, SP.
ISR and Written Opinion for PCT/US2012/049434, Date of Mailing Feb. 1, 2013.
N. Birbilis, et al., "Exploring Corrosion Protection of Mg Via Ionic Liquid Pretreatment", Surface & Coatings Technology; 201, pp. 4496-4504, (2007).
N. Carrejo et al., "Improving Flow Assurance in Multi-Zone Fracturing Treatments in Hydrocarben Reservoirs with High Strength Corrodible Tripping Balls"; Society of Petroleum Engineers; SPE Paper No. 151613; Apr. 16, 2012; 6 pages.
Office Action issued by the Canadian Intellectual Property Office on Feb. 25, 2013 for Canadian Pat. App. No. 2,783,241.
Office Action mailed from the Canadian Intellectual Property Office on Feb. 21, 2013 for CA Pat. App. No. 2,783,346.
S. Mathis, "Sand Management: A Review of Approaches and Concerns", Society of Petroleum Engineers, SPE Paper No. 82240, SPE European Formation Damage Conference, The Hague, The Netherlands, May 13-14, 2003.
Wikipedia, the free encyclopedia. Reactivity series. http://en.wikipedia.org/w/index.php?title=Reactivity_series&printable=yes downloaded on May 18, 2014. 8 pages.
Y. Li et al., "Investigation of aluminium-based nancompsoites with ultra-high strength", Materials Science and Engineering A, 527, pp. 305-316, (2009).
Vernon Constien et al., "Development of Reactive Coatings to Protect Sand-Control Screens", SPE 112494, Copyright 2008, Society of Petroleum Engineers, Presented at the 2008 SPE International Symposium and Exhibition on Formation Damage Control.
Adams, et al.; "Thermal stabilities of aromatic acids as geothermal tracers", Geotherrnics, vol. 21, No. 3, 1992, pp. 323-339.
Ayman, et al.; "Effect of Consolidation and Extrusion Temperatures on Tensile Properties of Hot Extruded ZK61 Magnesium Alloy Gas Atomized Powders via Spark Plasma Sintering", Transactions of JWRI, vol. 38 (2009), No. 2, pp. 1-5.
Baker Hughes Incorporated. IN-Tallic Disintegrating Frac Balls. Houston: Baker Hughes Incorporated, 2011. Accessed Mar. 6, 2015.
Baker Hughes, "Multistage", Oct. 31, 2011, BakerHughes.com; accessed Mar. 6, 2015.
Baker Oil Tools, "Z-Seal Metal-to-Metal Expandable Sealing Device Uses Expanding Metal in Place of Elastomers," Nov. 6, 2006.
Bastow, et al., "Clustering and formation of nano-precipitates in dilute aluminum and magnesium alloys", Materials Science and Engineering, 2003, C23, 757-762.
Bououdina, et al., "Comparative Study of Mechanical Alloying of (Mg+Al) and (Mg+Fai+Ni) Mixtures for Hydrogen Storage", J. Alloys, Compds, 2002, 336, 222-231.
Canadian Office Action for Canadian Application No. 2,833,958, dated Sep. 23, 2014, pp. 1-2.
Canadian Office Action for Canadian Application No. 2,833,981, dated Sep. 23, 2014, pp. 1-2.
Chinese Office Action for Chinese Application No. 201080055613.5, dated Nov. 4, 2014, pp. 1-20.
Feng, et al., "Electroless Plating of Carbon Nanotubes with Silver" Journal of Materials Science, 39, (2004) pp. 3241-3243.
Gray, et al., "Protective Coatings on Magnesium and Its Alloys—a Critical Review", Journal of Alloys and Compounds 336 (2002), pp. 88-113.
Han, et al., "Mechanical Properties of Nanostructured Materials", Rev. Adv. Mater. Sci. 9(2005) 1-16.
Hjortstam, et al. "Can we achieve ultra-low resistivity in carbon nanotube-based metal composites," Applied Physics A (2004), vol. 78, Issue 8, pp. 1175-1179.
International Search Report and Written Opinion; International Application No. PCT/US2012/038622; International Filing Date: May 18, 2012; Date of Mailing: Dec. 6, 2012; 12 pages.
International Search Report and Written Opinion; International Application No. PCT/US2012/053339; International Filing Date: Aug. 31, 2012; Date of Mailing: Feb. 15, 2013; 11 pages.
International Search Report and Written Opinion; International Application No. PCT/US2012/053342; International Filing Date: Aug. 31, 2012; Date of Mailing: Feb. 19, 2013; 9 pages.
International Search Report and Written Opinion; International Application No. PCT/US2012/053350; International Filing Date: Aug. 31, 2012; Date of Mailing: Feb. 25, 2013; 10 pages.
International Search Report and Written Opinion; International Application No. PCT/US2014/049347; International Filing Date: Aug. 1, 2014; Date of Mailing: Nov. 24, 2014; 11 pages.
International Search Report and Written Opinion; International Application No. PCT/US2014/054720; International Filing Date: Sep. 9, 2014; Date of Mailing: Dec. 17, 2014; 10 pages.
International Search Report for Application No. PCT/US2012/044229, International Filing Date Jun. 26, 2012; Issued Jan. 30, 2013. (3 pages).
Lavernia, et al.,"Cryomilled Nanostructured Materials: Processing and Properties", Materials Science and Engineering A, 493, (2008) pp. 207-214.
Liu, et al., "Calculated Phase Diagrams and the Corrosion of Die-Cast Mg—Al Alloys", Corrosion Science, 2009, 51, 606-619.
Majumdar, et al., "Laser Surface Engineering of a Magnesium Alloy with Al+A1203", Surface and Coatings Technology 179 (2004) pp. 297-305.
Murray, J. L. "Binary Alloy Phase Diagrams" Int. Met. Rev., 30(5) 1985 vol. 1, pp. 103-187.
Nie, "Patents of Methods to Prepare Intermetallic Matrix Composites: a Review", Recent Patents on Materials Science 2008, vol. 1, pp. 232-240.
Office Action, Issued Oct. 7, 2014, BAO0821CA.
Rose, et al.; "The application of the polyaromatic sulfonates as tracers in geothermal reservoirs", Geothermics 30 (2001) pp. 617-640.
Seyni, et al., "On the interest of using degradable fillers in co-ground composite materials", Powder Technology 190, (2009) pp. 176-184.
Shaw, "Benefits and Application of a Surface-Controlled Sliding Sleeve for Fracturing Operations"; Society of Petroleum Engineers, SPE Paper No. 147546; Oct. 30, 2011; 8 pages.
Shigematsu, et al., "Surface Treatment of AZ91D Magnesium Alloy by Aluminum diffusion Coating", Journal of Materials Science Letters 19, 2000, pp. 473-475.
Shimizu, et al., "Multi-walled carbon nanotube-reinforced magnesium alloy composites", Scripta Materialia, vol. 58, Issue 4, Feb. 2008, pp. 267-270.
Singh, et al., "Extended Homogeneity Range of Intermetallic Phases in Mechanically Alloyed Mg—Al Alloys", Elsevier Sciences Ltd., Intemetallics 11, 2003, pp. 373-376.
Song, et al.; "A Possible Biodegradable Magnesium Implant Material," Advanced Engineering Materials, vol. 9, Issue 4, Apr. 2007, pp. 298-302.
Song, G. et al. "Understanding Magnesium Corrosion" Advanced Engineering Materials 2003, 5, No. 12. pp. 837-858.
Stanley, et al.; "An Introduction to Ground-Water Tracers", Department of Hydrology and Water Resources, University of Arizona, Mar. 1985, pp. 1-219.
Sun, et al.; "Colloidal Processing of Carbon Nanotube/Alumina Composites" Chem. Mater. 2002, 14, pp. 5169-5172.
Vahlas, et al., "Principles and Applications of CVD Powder Technology", Materials Science and Engineering R 53 (2006) pp. 1-72.
Walters, et al.; "A Study of Jets from Unsintered-Powder Metal Lined Nonprecision Small-Caliber Shaped Charges", Army Research Laboratory, Aberdeen Proving Ground, MD 21005-5066; Feb. 2001.
Xu, et al., "Nanostructured Material-Based Completion Tools Enhance Well Productivity"; International Petroleum Technology Conference; Conference Paper IPTC 16538; International Petroleum Technology Conference 2013; 4 pages.
Zemel, "Tracers in the Oil Field", University of Texas at Austin, Center for Petroleum and Geosystems, Jan. 1995, Chapters 1, 2, 3, 7.
Zeng, et al. "Progress and Challenge for Magnesium Alloys as Biomaterials," Advanced Engineering Materials, vol. 10, Issue 8, Aug. 2008, pp. B3-B14.

(56) References Cited

OTHER PUBLICATIONS

Zhang, et al.; "Formation of metal nanowires on suspended single-walled carbon nanotubes" Applied Physics Letter, vol. 77, No. 19 (2000), pp. 3015-3017.

Zhang, et al.; "High Strength Nanostructured Materials and Their Oil Field Applications"; Society of Petroleum Engineers; Conference Paper Spe 157092; SPE International Oilfield Nanotechnology Conference, 2012; 6 pages.

Zhang, et al.; "Metal Coating on Suspended Carbon Nanotubes and its Implication to Metal-Tube Interaction", Chemical Physics Letters 331 (2000) 35-41.

Bin et al., "Advances in Fluidization CVD Technology", East China University of Chemical Technology, China Academic Journal Electronic Publishing House, vol. 13, No. 4, Nov. 1992, pp. 360-365, English Abstract on p. 366.

Lin et al., "Processing and Microstructure of Nano-Mo/Al2O3 Composites from MOCVD and Fluidized Bed", Nanostructured Materials, Nov. 1999, vol. 11, No. 8, pp. 1361-1377.

M.S. Senthil Saravanan et al., "Mechanically Alloyed Carbon Nanotubes (CNT) Reinforced Nanocrystalline AA 4032: Synthesis and Characterization," Journal of Minerals & Materials Characterization & Engineering, vol. 9, No. 11, pp. 1027-1035, 2010.

S.R. Bakshi et al, "Carbon nanotube reinforced metal matrix composites—a review," International Materials Reviews; 2010, pp. 41-64, vol. 55, No. 1.

Spencer et al., "Fluidized Bed Polymer Particle ALD Process for Producing HDPE/Alumina Nanocomposites" in "The 12th International Conference on Fluidization - New Horizons in Fluidization Engineering"[. . .] vol. RP4 (2007).

* cited by examiner

DISSOLVABLE TOOL

CROSS REFERENCE TO RELATED APPLICATION

This application is a divisional application of U.S. application Ser. No. 12/633,662 filed Dec. 8, 2009, the entire contents of which are incorporated herein by reference.

BACKGROUND

In the subterranean drilling and completion industry there are times when a downhole tool located within a wellbore becomes an unwanted obstruction. Accordingly, downhole tools have been developed that can be deformed, by operator action, for example, such that the tool's presence becomes less burdensome. Although such tools work as intended, their presence, even in a deformed state can still be undesirable. Devices and methods to further remove the burden created by the presence of unnecessary downhole tools are therefore desirable in the art.

BRIEF DESCRIPTION

Disclosed herein is a method of dissolving a tool. The method includes, exposing an outer surface of the tool to an environment reactive with the tool, reacting the tool with the environment, applying stress to the tool, concentrating stress on the tool at stress risers in the outer surface, and initiating fracturing the tool at the stress risers.

Further disclosed herein is a dissolvable tool. The tool includes, a body having at least one stress riser configured to concentrate stress thereat to accelerate structural degradation of the body through chemical reaction under applied stress within a reactive environment.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
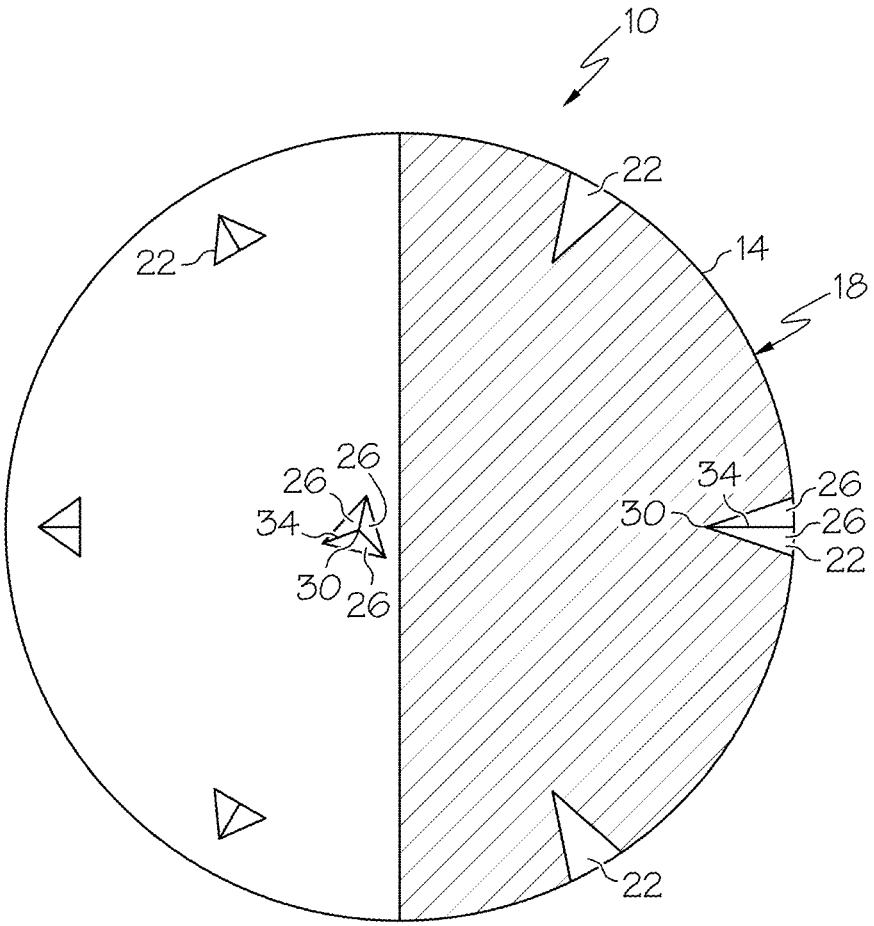
FIG. 1 depicts a quarter cross sectional view of a dissolvable tool disclosed herein.

Referring to FIG. 1, a quarter cross sectional view of an embodiment of a dissolvable tool disclosed herein is illustrated generally at 10. The tool 10, includes a body 14 illustrated in this embodiment as a ball, however, alternate embodiments are contemplated such as, an ellipsoid, a cylinder or a polyhedron, for example. The body 14 has a surface 18 that has a plurality of stress risers 22. The stress risers 22 illustrated herein are indentations, however, alternate embodiments may employ stress risers 22 with other configurations, such as, cracks or foreign bodies, for example. Additionally, alternate embodiments may employ any number of stress risers 22 including embodiments with just a single stress riser 22. The stress risers 22 are configured to concentrate stress at the specific locations of the body 14 where the stress risers 22 are located. This concentrated stress initiates micro-cracks that once nucleated propagate through the body 14 leading to fracture of the body 14. The stress risers 22 can, therefore, control strength of the body and define values of mechanical stress that will result in failure. Additionally, exposure of the body 14 to environments that are reactive with the material of the body 14 accelerates reaction of the body 14, such as chemical reactions, for example, at the locations of the stress risers 22. This accelerated reaction will weaken the body 14 further at the stress riser 22 locations facilitating fracture and dissolution of the tool 10.

In an application, such as in the downhole hydrocarbon recovery industry, for example, the tool 10 may be a tripping ball. The ball 10 can be dropped or pumped within a wellbore (not shown), where it seals with a seat allowing pressure to be applied thereagainst to actuate a mechanism, such as a fracturing valve, for example, to open ports in the wellbore to facilitate treatments, like fracturing or acid treating, of a formation. In this application the downhole environment may include high temperatures, high pressures, and caustic chemicals such as acids, bases and brine solutions, for example. By making the body 14 of a material, such as, a lightweight, high-strength metallic material usable in both durable and disposable or degradable articles as disclosed in greater detail starting in paragraph [0031] below, the body 14 can be made to decrease in strength from exposure to the downhole environment. The initiation of dissolution or disintegration of the body 14 in the environment will decrease the strength of the body 14 and will allow the body 14 to fracture under stress, such as mechanical stress, for example. Examples of mechanical stress include stress from hydrostatic pressure and from a pressure differential applied across the body 14 as it is seated against a seat. The fracturing can break the body 14 into many small pieces that are not detrimental to further operation of the well, thereby negating the need to either pump the body 14 out of the wellbore or run a tool within the wellbore to drill or mill the ball into pieces small enough to remove hindrance therefrom.

The stress risers 22 of FIG. 1 are indentations that have a plurality of flat surfaces 26, with three surfaces 26 being shown, that extend from the surface 18 to a vertex 30. The vertex 30, being defined as a sharp intersection of the three surfaces 26, concentrates stress thereat. An additional stress concentration also occurs along lines 34 defined by the intersections of any two of the surfaces 26. Although the stress risers 22 shown here are indentations defined by flat surfaces 26, alternate embodiments may employ other stress risers 22 as will be described below.

Figure 2:
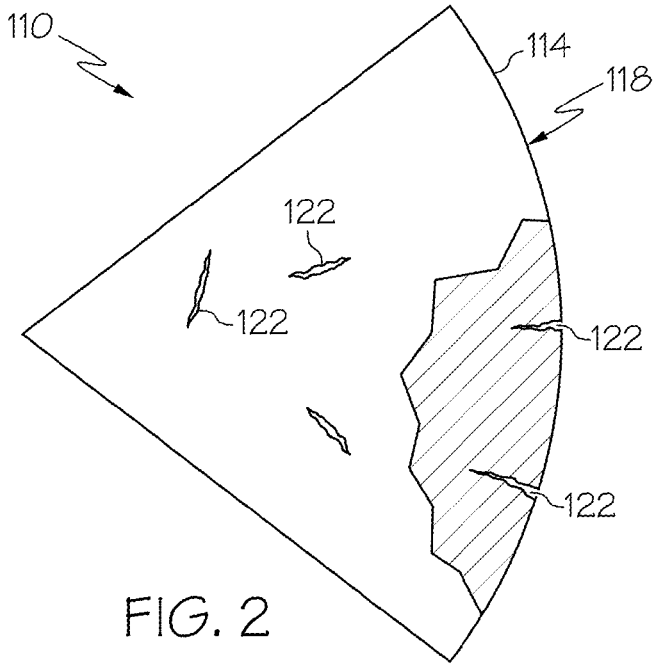
FIG. 2 depicts a partial sectioned view of an alternate embodiment of a dissolvable tool disclosed herein.

Referring to FIG. 2, a partial cross sectional view of an alternate embodiment of a dissolvable tool disclosed herein is illustrated generally at 110. The tool 110 has a body 114 that includes a plurality of stress risers 122 defined by cracks that extend radially inwardly from a surface 118 of the body 114.

Figure 3:
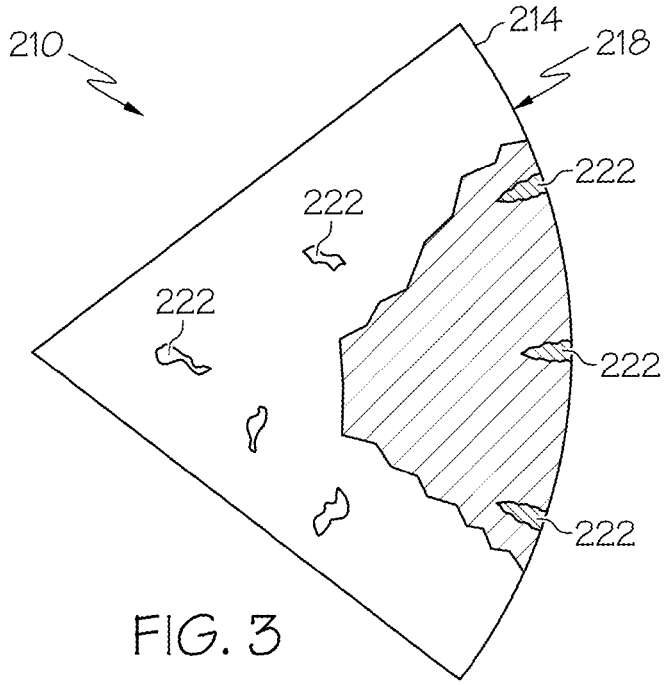
FIG. 3 depicts a partial sectioned view of an alternate embodiment of a dissolvable tool disclosed herein.

Referring to FIG. 3, a partial cross sectional view of an alternate embodiment of a dissolvable tool disclosed herein is illustrated generally at 210. The tool 20 has a body 214 that includes a plurality of stress risers 222 defined by foreign bodies 224 embedded therein. The foreign bodies 224 extend radially inwardly from a surface 218 of the body 214. The foreign bodies 224 can be any material other than the material from which the body 214 is made, however, making the foreign bodies 224 from a material more reactive with the anticipated environment may be desirable to accelerate the weakening of the body 214 further.

Figure 4:
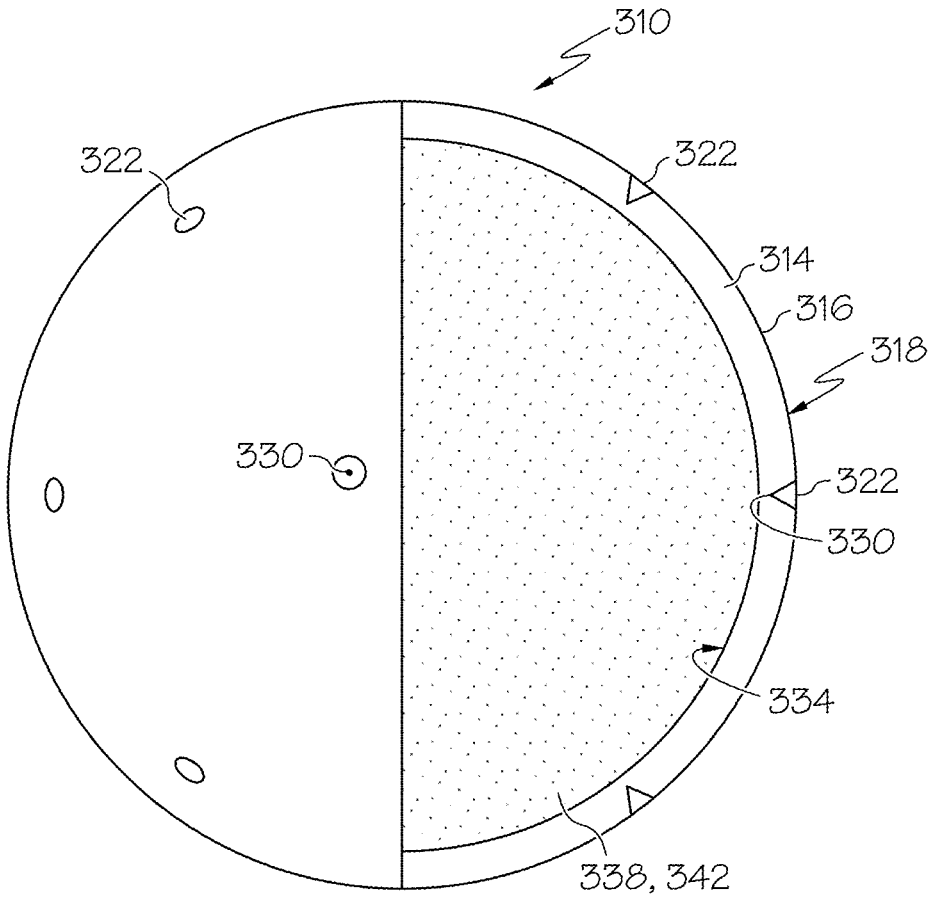
FIG. 4 depicts a quarter cross sectional view of an alternate embodiment of a dissolvable tool disclosed herein.

Referring to FIG. 4, a quarter cross sectional view of an alternate embodiment of a dissolvable tool disclosed herein is illustrated generally at 310. The tool 310 has a body 314 made of a shell 316 defining a surface 318. The shell 316 has a plurality of stress risers 322 that are shown in this embodiment as conical indentations that extend radially inwardly from the surface 318 to a vertex 330. The vertex 330 is located within the shell 316 and does not extend radially inwardly of an inner surface 334 of the shell 316. The body 314 may be hollow, may be filled with a fluid 338, may have a core 342 made of a fluidized material, such as a powder, that may provide some support to the shell 316 while easily dissolving within the environment once the shell 316 is fractured, or may have a solid core 346 made of a softer material than the shell 316.

The shell 316 of the tool 310 primarily determines the strength thereof. As such, once micro-cracks form in the shell 316 the compressive load bearing capability is significantly reduced leading to rupture shortly thereafter. Consequently, the stress risers 322 can accurately control timing of strength degradation of the tool 310 once the tool 310 is exposed to a reactive environment.

Materials for the body 14, 114, 214, 314, may include, lightweight, high-strength metallic materials are disclosed that may be used in a wide variety of applications and application environments, including use in various wellbore environments to make various selectably and controllably disposable or degradable lightweight, high-strength downhole tools or other downhole components, as well as many other applications for use in both durable and disposable or degradable articles. These lightweight, high-strength and selectably and controllably degradable materials include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in wellbore applications. These powder compacts provide a unique and advantageous combination of mechanical strength properties, such as compression and shear strength, low density and selectable and controllable corrosion properties, particularly rapid and controlled dissolution in various wellbore fluids. For example, the particle core and coating layers of these powders may be selected to provide sintered powder compacts suitable for use as high strength engineered materials having a compressive strength and shear strength comparable to various other engineered materials, including carbon, stainless and alloy steels, but which also have a low density comparable to various polymers, elastomers, low-density porous ceramics and composite materials. As yet another example, these powders and powder compact materials may be configured to provide a selectable and controllable degradation or disposal in response to a change in an environmental condition, such as a transition from a very low dissolution rate to a very rapid dissolution rate in response to a change in a property or condition of a wellbore proximate an article formed from the compact, including a property change in a wellbore fluid that is in contact with the powder compact. The selectable and controllable degradation or disposal characteristics described also allow the dimensional stability and strength of articles, such as wellbore tools or other components, made from these materials to be maintained until they are no longer needed, at which time a predetermined environmental condition, such as a wellbore condition, including wellbore fluid temperature, pressure or pH value, may be changed to promote their removal by rapid dissolution. These coated powder materials and powder compacts and engineered materials formed from them, as well as methods of making them, are described further below.

Figure 5:
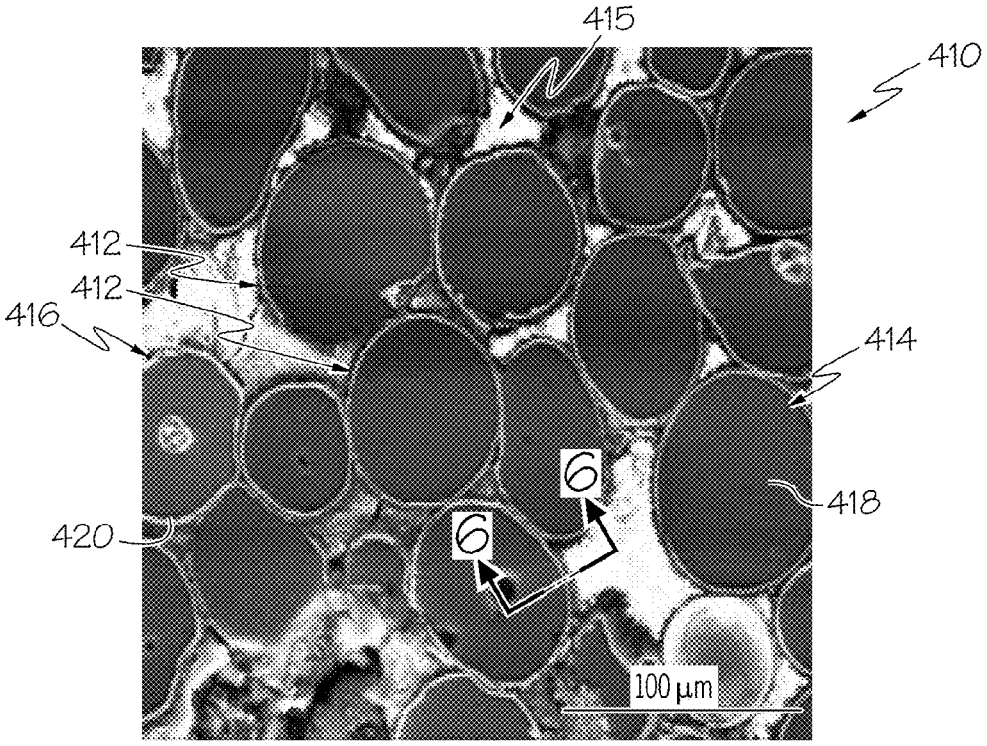
FIG. 5 is a photomicrograph of a powder as disclosed herein that has been embedded in a potting material and sectioned.

Referring to FIG. 5, a metallic powder 410 includes a plurality of metallic, coated powder particles 412. Powder particles 412 may be formed to provide a powder 410, including free-flowing powder, that may be poured or otherwise disposed in all manner of forms or molds (not shown) having all manner of shapes and sizes and that may be used to fashion powder compacts 600 (FIGS. 8 and 9), as described herein, that may be used as, or for use in manufacturing, various articles of manufacture, including various wellbore tools and components.

Each of the metallic, coated powder particles 412 of powder 410 includes a particle core 414 and a metallic coating layer 416 disposed on the particle core 414. The particle core 414 includes a core material 418. The core material 418 may include any suitable material for forming the particle core 414 that provides powder particle 412 that can be sintered to form a lightweight, high-strength powder compact 600 having selectable and controllable dissolution characteristics. Suitable core materials include electrochemically active metals having a standard oxidation potential greater than or equal to that of Zn, including as Mg, Al, Mn or Zn or a combination thereof. These electrochemically active metals are very reactive with a number of common wellbore fluids, including any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). Core material 418 may also include other metals that are less electrochemically active than Zn or non-metallic materials, or a combination thereof. Suitable non-metallic materials include ceramics, composites, glasses or carbon, or a combination thereof. Core material 418 may be selected to provide a high dissolution rate in a predetermined wellbore fluid, but may also be selected to provide a relatively low dissolution rate, including zero dissolution, where dissolution of the nanomatrix material causes the particle core 414 to be rapidly undermined and liberated from the particle compact at the interface with the wellbore fluid, such that the effective rate of dissolution of particle compacts made using particle cores 414 of these core materials 418 is high, even though core material 418 itself may have a low dissolution rate, including core materials 420 that may be substantially insoluble in the wellbore fluid.

With regard to the electrochemically active metals as core materials 418, including Mg, Al, Mn or Zn, these metals may be used as pure metals or in any combination with one another, including various alloy combinations of these materials, including binary, tertiary, or quaternary alloys of these materials. These combinations may also include composites of these materials. Further, in addition to combinations with one another, the Mg, Al, Mn or Zn core materials 418 may also include other constituents, including various alloying additions, to alter one or more properties of the particle cores 414, such as by improving the strength, lowering the density or altering the dissolution characteristics of the core material 418.

Among the electrochemically active metals, Mg, either as a pure metal or an alloy or a composite material, is particularly useful, because of its low density and ability to form high-strength alloys, as well as its high degree of electrochemical activity, since it has a standard oxidation potential higher than Al, Mn or Zn. Mg alloys include all alloys that have Mg as an alloy constituent. Mg alloys that combine other electrochemically active metals, as described herein, as alloy constituents are particularly useful, including binary Mg—Zn, Mg—Al and Mg—Mn alloys, as well as tertiary Mg—Zn—Y and Mg—Al—X alloys, where X includes Zn, Mn, Si, Ca or Y, or a combination thereof. These Mg—Al—X alloys may include, by weight, up to about 85% Mg, up to about 15% Al and up to about 5% X. Particle core 414 and core material 418, and particularly electrochemically active metals including Mg, Al, Mn or Zn, or combinations thereof, may also include a rare earth element or combination of rare earth elements. As used herein, rare earth elements include Sc, Y, La, Ce, Pr, Nd or Er, or a combination of rare earth elements. Where present, a rare earth element or combinations of rare earth elements may be present, by weight, in an amount of about 5% or less.

Particle core 414 and core material 418 have a melting temperature ($T_P$). As used herein, $T_P$ includes the lowest temperature at which incipient melting or liquation or other forms of partial melting occur within core material 418, regardless of whether core material 418 comprises a pure metal, an alloy with multiple phases having different melting temperatures or a composite of materials having different melting temperatures.

Particle cores 414 may have any suitable particle size or range of particle sizes or distribution of particle sizes. For example, the particle cores 414 may be selected to provide an average particle size that is represented by a normal or Gaussian type unimodal distribution around an average or mean, as illustrated generally in FIG. 5. In another example, particle cores 414 may be selected or mixed to provide a multimodal distribution of particle sizes, including a plurality of average particle core sizes, such as, for example, a homogeneous bimodal distribution of average particle sizes. The selection of the distribution of particle core size may be used to determine, for example, the particle size and interparticle spacing 415 of the particles 412 of powder 410. In an exemplary embodiment, the particle cores 414 may have a unimodal distribution and an average particle diameter of about 5 μm to about 300 μm, more particularly about 80 μm to about 120 μm, and even more particularly about 100 μm.

Particle cores 414 may have any suitable particle shape, including any regular or irregular geometric shape, or combination thereof. In an exemplary embodiment, particle cores 414 are substantially spheroidal electrochemically active metal particles. In another exemplary embodiment, particle cores 414 are substantially irregularly shaped ceramic particles. In yet another exemplary embodiment, particle cores 414 are carbon or other nanotube structures or hollow glass microspheres.

Figure 6:
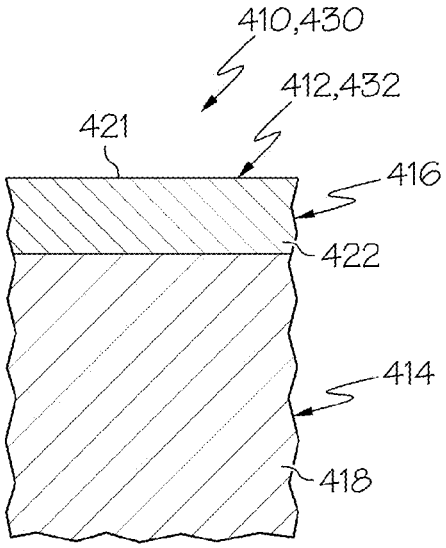
FIG. 6 is a schematic illustration of an exemplary embodiment of a powder particle as it would appear in an exemplary section view represented by section 6-6 of FIG. 5.

Each of the metallic, coated powder particles 412 of powder 410 also includes a metallic coating layer 416 that is disposed on particle core 414. Metallic coating layer 416 includes a metallic coating material 420. Metallic coating material 420 gives the powder particles 412 and powder 410 its metallic nature. Metallic coating layer 16 is a nanoscale coating layer. In an exemplary embodiment, metallic coating layer 416 may have a thickness of about 25 nm to about 2500 nm. The thickness of metallic coating layer 416 may vary over the surface of particle core 414, but will preferably have a substantially uniform thickness over the surface of particle core 414. Metallic coating layer 416 may include a single layer, as illustrated in FIG. 6, or a plurality of layers as a multilayer coating structure. In a single layer coating, or in each of the layers of a multilayer coating, the metallic coating layer 416 may include a single constituent chemical element or compound, or may include a plurality of chemical elements or compounds. Where a layer includes a plurality of chemical constituents or compounds, they may have all manner of homogeneous or heterogeneous distributions, including a homogeneous or heterogeneous distribution of metallurgical phases. This may include a graded distribution where the relative amounts of the chemical constituents or compounds vary according to respective constituent profiles across the thickness of the layer. In both single layer and multilayer coatings 416, each of the respective layers, or combinations of them, may be used to provide a predetermined property to the powder particle 412 or a sintered powder compact formed therefrom. For example, the predetermined property may include the bond strength of the metallurgical bond between the particle core 414 and the coating material 420; the interdiffusion characteristics between the particle core 414 and metallic coating layer 416, including any interdiffusion between the layers of a multilayer coating layer 416; the interdiffusion characteristics between the various layers of a multilayer coating layer 416; the interdiffusion characteristics between the metallic coating layer 416 of one powder particle and that of an adjacent powder particle 412; the bond strength of the metallurgical bond between the metallic coating layers of adjacent sintered powder particles 412, including the outermost layers of multilayer coating layers; and the electrochemical activity of the coating layer 416.

Metallic coating layer 416 and coating material 420 have a melting temperature ($T_C$). As used herein, $T_C$ includes the lowest temperature at which incipient melting or liquation or other forms of partial melting occur within coating material 420, regardless of whether coating material 420 comprises a pure metal, an alloy with multiple phases each having different melting temperatures or a composite, including a composite comprising a plurality of coating material layers having different melting temperatures.

Metallic coating material 420 may include any suitable metallic coating material 20 that provides a sinterable outer surface 421 that is configured to be sintered to an adjacent powder particle 412 that also has a metallic coating layer 416 and sinterable outer surface 421. In powders 410 that also include second or additional (coated or uncoated) particles 432, as described herein, the sinterable outer surface 421 of metallic coating layer 416 is also configured to be sintered to a sinterable outer surface 421 of second particles 432. In an exemplary embodiment, the powder particles 412 are sinterable at a predetermined sintering temperature ($T_S$) that is a function of the core material 418 and coating material 420, such that sintering of powder compact 600 is accomplished entirely in the solid state and where $T_S$ is less than $T_P$ and $T_C$. Sintering in the solid state limits particle core 414/metallic coating layer 416 interactions to solid state diffusion processes and metallurgical transport phenomena and limits growth of and provides control over the resultant interface between them. In contrast, for example, the introduction of liquid phase sintering would provide for rapid interdiffusion of the particle core 414/metallic coating layer 416 materials and make it difficult to limit the growth of and provide control over the resultant interface between them, and thus interfere with the formation of the desirable microstructure of particle compact 600 as described herein.

In an exemplary embodiment, core material 418 will be selected to provide a core chemical composition and the coating material 420 will be selected to provide a coating chemical composition and these chemical compositions will also be selected to differ from one another. In another exemplary embodiment, the core material 418 will be selected to provide a core chemical composition and the coating material 420 will be selected to provide a coating chemical composition and these chemical compositions will also be selected to differ from one another at their interface. Differences in the chemical compositions of coating material 420 and core material 418 may be selected to provide different dissolution rates and selectable and controllable dissolution of powder compacts 600 that incorporate them making them selectably and controllably dissolvable. This includes dissolution rates that differ in response to a changed condition in the wellbore, including an indirect or direct change in a wellbore fluid. In an exemplary embodiment, a powder compact 600 formed from powder 410 having chemical compositions of core material 418 and coating material 420 that make compact 600 is selectably dissolvable in a wellbore fluid in response to a changed wellbore condition that includes a change in temperature, change in pressure, change in flow rate, change in pH or change in chemical composition of the wellbore fluid, or a combination thereof. The selectable dissolution response to the changed condition may result from actual chemical reactions or processes that promote different rates of dissolution, but also encompass changes in the dissolution response that are associated with physical reactions or processes, such as changes in wellbore fluid pressure or flow rate.

Figure 7:
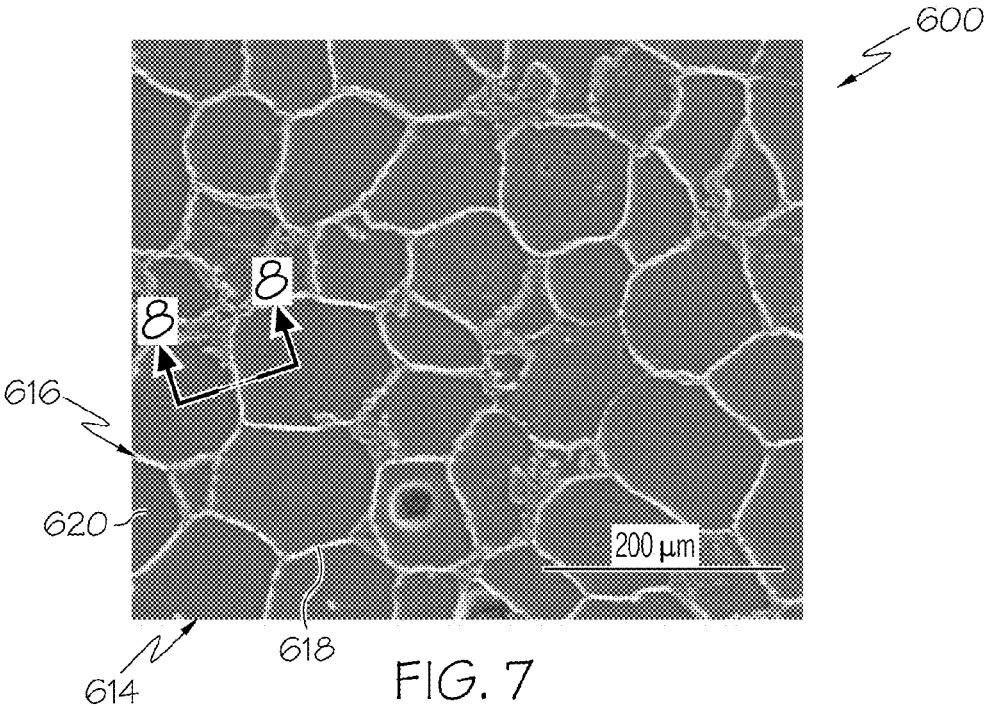
FIG. 7 is a photomicrograph of an exemplary embodiment of a powder compact as disclosed herein.

As illustrated in FIGS. 5 and 7, particle core 414 and core material 418 and metallic coating layer 416 and coating material 420 may be selected to provide powder particles 412 and a powder 410 that is configured for compaction and sintering to provide a powder compact 600 that is lightweight (i.e., having a relatively low density), high-strength and is selectably and controllably removable from a wellbore in response to a change in a wellbore property, including being selectably and controllably dissolvable in an appropriate wellbore fluid, including various wellbore fluids as disclosed herein. Powder compact 600 includes a substantially-continuous, cellular nanomatrix 616 of a nanomatrix material 620 having a plurality of dispersed particles 614 dispersed throughout the cellular nanomatrix 616. The substantially-continuous cellular nanomatrix 616 and nanomatrix material 620 formed of sintered metallic coating layers 416 is formed by the compaction and sintering of the plurality of metallic coating layers 416 of the plurality of powder particles 412. The chemical composition of nanomatrix material 620 may be different than that of coating material 420 due to diffusion effects associated with the sintering as described herein. Powder metal compact 600 also includes a plurality of dispersed particles 614 that comprise particle core material 618. Dispersed particle cores 614 and core material 618 correspond to and are formed from the plurality of particle cores 414 and core material 418 of the plurality of powder particles 412 as the metallic coating layers 416 are sintered together to form nanomatrix 616. The chemical composition of core material 618 may be different than that of core material 418 due to diffusion effects associated with sintering as described herein.

As used herein, the use of the term substantially-continuous cellular nanomatrix 616 does not connote the major constituent of the powder compact, but rather refers to the minority constituent or constituents, whether by weight or by volume. This is distinguished from most matrix composite materials where the matrix comprises the majority constituent by weight or volume. The use of the term substantially-continuous, cellular nanomatrix is intended to describe the extensive, regular, continuous and interconnected nature of the distribution of nanomatrix material 620 within powder compact 600. As used herein, "substantially-continuous" describes the extension of the nanomatrix material throughout powder compact 600 such that it extends between and envelopes substantially all of the dispersed particles 614. Substantially-continuous is used to indicate that complete continuity and regular order of the nanomatrix around each dispersed particle 614 is not required. For example, defects in the coating layer 416 over particle core 414 on some powder particles 412 may cause bridging of the particle cores 414 during sintering of the powder compact 600, thereby causing localized discontinuities to result within the cellular nanomatrix 616, even though in the other portions of the powder compact the nanomatrix is substantially continuous and exhibits the structure described herein. As used herein, "cellular" is used to indicate that the nanomatrix defines a network of generally repeating, interconnected, compartments or cells of nanomatrix material 620 that encompass and also interconnect the dispersed particles 614. As used herein, "nanomatrix" is used to describe the size or scale of the matrix, particularly the thickness of the matrix between adjacent dispersed particles 614. The metallic coating layers that are sintered together to form the nanomatrix are themselves nanoscale thickness coating layers. Since the nanomatrix at most locations, other than the intersection of more than two dispersed particles 614, generally comprises the interdiffusion and bonding of two coating layers 416 from adjacent powder particles 412 having nanoscale thicknesses, the matrix formed also has a nanoscale thickness (e.g., approximately two times the coating layer thickness as described herein) and is thus described as a nanomatrix. Further, the use of the term dispersed particles 614 does not connote the minor constituent of powder compact 600, but rather refers to the majority constituent or constituents, whether by weight or by volume. The use of the term dispersed particle is intended to convey the discontinuous and discrete distribution of particle core material 618 within powder compact 600.

Powder compact 600 may have any desired shape or size, including that of a cylindrical billet or bar that may be machined or otherwise used to form useful articles of manufacture, including various wellbore tools and components. The sintering and pressing processes used to form powder compact 600 and deform the powder particles 412, including particle cores 414 and coating layers 416, to provide the full density and desired macroscopic shape and size of powder compact 600 as well as its microstructure. The microstructure of powder compact 600 includes an equiaxed configuration of dispersed particles 614 that are dispersed throughout and embedded within the substantially-continuous, cellular nanomatrix 616 of sintered coating layers. This microstructure is somewhat analogous to an equiaxed grain microstructure with a continuous grain boundary phase, except that it does not require the use of alloy constituents having thermodynamic phase equilibria properties that are capable of producing such a structure. Rather, this equiaxed dispersed particle structure and cellular nanomatrix 616 of sintered metallic coating layers 416 may be produced using constituents where thermodynamic phase equilibrium conditions would not produce an equiaxed structure. The equiaxed morphology of the dispersed particles 614 and cellular network 616 of particle layers results from sintering and deformation of the powder particles 412 as they are compacted and interdiffuse and deform to fill the interparticle spaces 415 (FIG. 5). The sintering temperatures and pressures may be selected to ensure that the density of powder compact 600 achieves substantially full theoretical density.

Figure 8:
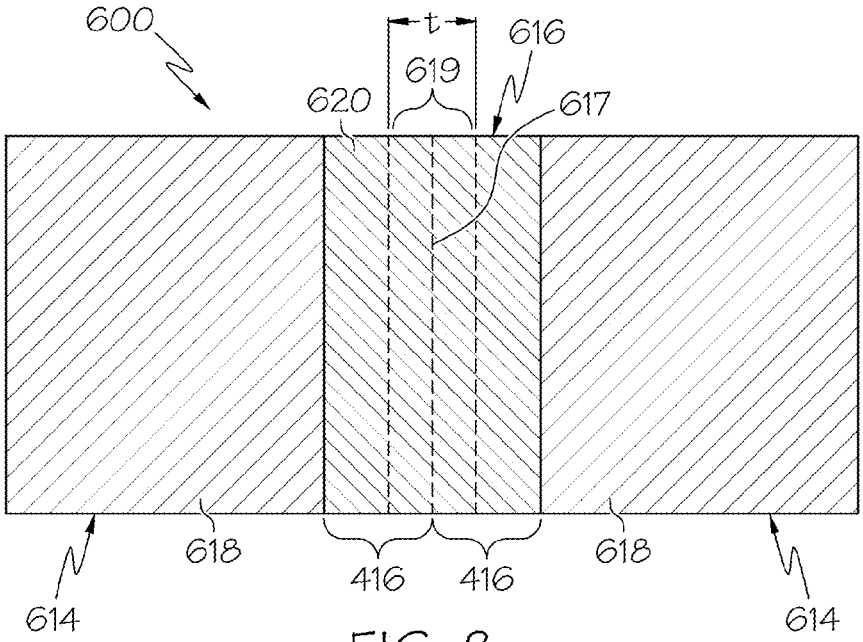
FIG. 8 is a schematic illustration of an exemplary embodiment of the powder compact of FIG. 7 made using a powder having single-layer powder particles as it would appear taken along section 8-8.

In an exemplary embodiment as illustrated in FIGS. 5 and 7, dispersed particles 614 are formed from particle cores 414 dispersed in the cellular nanomatrix 616 of sintered metallic coating layers 416, and the nanomatrix 616 includes a solid-state metallurgical bond 617 or bond layer 619, as illustrated schematically in FIG. 8, extending between the dispersed particles 614 throughout the cellular nanomatrix 616 that is formed at a sintering temperature ($T_S$), where $T_S$ is less than $T_C$ and $T_P$. As indicated, solid-state metallurgical bond 617 is formed in the solid state by solid-state interdiffusion between the coating layers 416 of adjacent powder particles 412 that are compressed into touching contact during the compaction and sintering processes used to form powder compact 600, as described herein. As such, sintered coating layers 416 of cellular nanomatrix 616 include a solid-state bond layer 619 that has a thickness (t) defined by the extent of the interdiffusion of the coating materials 420 of the coating layers 416, which will in turn be defined by the nature of the coating layers 416, including whether they are single or multilayer coating layers, whether they have been selected to promote or limit such interdiffusion, and other factors, as described herein, as well as the sintering and compaction conditions, including the sintering time, temperature and pressure used to form powder compact 600.

As nanomatrix 616 is formed, including bond 617 and bond layer 619, the chemical composition or phase distribution, or both, of metallic coating layers 416 may change. Nanomatrix 616 also has a melting temperature ($T_M$). As used herein, $T_M$ includes the lowest temperature at which incipient melting or liquation or other forms of partial melting will occur within nanomatrix 616, regardless of whether nanomatrix material 620 comprises a pure metal, an alloy with multiple phases each having different melting temperatures or a composite, including a composite comprising a plurality of layers of various coating materials having different melting temperatures, or a combination thereof, or otherwise. As dispersed particles 614 and particle core materials 618 are formed in conjunction with nanomatrix 616, diffusion of constituents of metallic coating layers 416 into the particle cores 414 is also possible, which may result in changes in the chemical composition or phase distribution, or both, of particle cores 414. As a result, dispersed particles 614 and particle core materials 618 may have a melting temperature ($T_{DP}$) that is different than $T_P$. As used herein, $T_{DP}$ includes the lowest temperature at which incipient melting or liquation or other forms of partial melting will occur within dispersed particles 614, regardless of whether particle core material 618 comprise a pure metal, an alloy with multiple phases each having different melting temperatures or a composite, or otherwise. Powder compact 600 is formed at a sintering temperature ($T_S$), where $T_S$ is less than $T_C$, $T_P$, $T_M$ and $T_{DP}$.

Dispersed particles 614 may comprise any of the materials described herein for particle cores 414, even though the chemical composition of dispersed particles 614 may be different due to diffusion effects as described herein. In an exemplary embodiment, dispersed particles 614 are formed from particle cores 414 comprising materials having a standard oxidation potential greater than or equal to Zn, including Mg, Al, Zn or Mn, or a combination thereof, may include various binary, tertiary and quaternary alloys or other combinations of these constituents as disclosed herein in conjunction with particle cores 414. Of these materials, those having dispersed particles 614 comprising Mg and the nanomatrix 616 formed from the metallic coating materials 416 described herein are particularly useful. Dispersed particles 614 and particle core material 618 of Mg, Al, Zn or Mn, or a combination thereof, may also include a rare earth element, or a combination of rare earth elements as disclosed herein in conjunction with particle cores 414.

In another exemplary embodiment, dispersed particles 614 are formed from particle cores 414 comprising metals that are less electrochemically active than Zn or non-metallic materials. Suitable non-metallic materials include ceramics, glasses (e.g., hollow glass microspheres) or carbon, or a combination thereof, as described herein.

Dispersed particles 614 of powder compact 600 may have any suitable particle size, including the average particle sizes described herein for particle cores 414.

Dispersed particles 614 may have any suitable shape depending on the shape selected for particle cores 414 and powder particles 412, as well as the method used to sinter and compact powder 410. In an exemplary embodiment, powder particles 412 may be spheroidal or substantially spheroidal and dispersed particles 614 may include an equiaxed particle configuration as described herein.

The nature of the dispersion of dispersed particles 614 may be affected by the selection of the powder 410 or powders 410 used to make particle compact 600. In one exemplary embodiment, a powder 410 having a unimodal distribution of powder particle 412 sizes may be selected to form powder compact 600 and will produce a substantially homogeneous unimodal dispersion of particle sizes of dispersed particles 614 within cellular nanomatrix 616, as illustrated generally in FIG. 7. In another exemplary embodiment, a plurality of powders 410 having a plurality of powder particles with particle cores 414 that have the same core materials 418 and different core sizes and the same coating material 420 may be selected and uniformly mixed as described herein to provide a powder 410 having a homogenous, multimodal distribution of powder particle 412 sizes, and may be used to form powder compact 600 having a homogeneous, multimodal dispersion of particle sizes of dispersed particles 614 within cellular nanomatrix 616. Similarly, in yet another exemplary embodiment, a plurality of powders 410 having a plurality of particle cores 414 that may have the same core materials 418 and different core sizes and the same coating material 420 may be selected and distributed in a non-uniform manner to provide a non-homogenous, multimodal distribution of powder particle sizes, and may be used to form powder compact 600 having a non-homogeneous, multimodal dispersion of particle sizes of dispersed particles 614 within cellular nanomatrix 616. The selection of the distribution of particle core size may be used to determine, for example, the particle size and interparticle spacing of the dispersed particles 614 within the cellular nanomatrix 616 of powder compacts 600 made from powder 410.

Nanomatrix 616 is a substantially-continuous, cellular network of metallic coating layers 416 that are sintered to one another. The thickness of nanomatrix 616 will depend on the nature of the powder 410 or powders 410 used to form powder compact 600, as well as the incorporation of any second powder 430, particularly the thicknesses of the coating layers associated with these particles. In an exemplary embodiment, the thickness of nanomatrix 616 is substantially uniform throughout the microstructure of powder compact 600 and comprises about two times the thickness of the coating layers 416 of powder particles 412. In another exemplary embodiment, the cellular network 616 has a substantially uniform average thickness between dispersed particles 614 of about 50 nm to about 5000 nm.

Nanomatrix 616 is formed by sintering metallic coating layers 416 of adjacent particles to one another by interdiffusion and creation of bond layer 619 as described herein. Metallic coating layers 416 may be single layer or multilayer structures, and they may be selected to promote or inhibit diffusion, or both, within the layer or between the layers of metallic coating layer 416, or between the metallic coating layer 416 and particle core 414, or between the metallic coating layer 416 and the metallic coating layer 416 of an adjacent powder particle, the extent of interdiffusion of metallic coating layers 416 during sintering may be limited or extensive depending on the coating thicknesses, coating material or materials selected, the sintering conditions and other factors. Given the potential complexity of the interdiffusion and interaction of the constituents, description of the resulting chemical composition of nanomatrix 616 and nanomatrix material 620 may be simply understood to be a combination of the constituents of coating layers 416 that may also include one or more constituents of dispersed particles 614, depending on the extent of interdiffusion, if any, that occurs between the dispersed particles 614 and the nanomatrix 616. Similarly, the chemical composition of dispersed particles 614 and particle core material 618 may be simply understood to be a combination of the constituents of particle core 414 that may also include one or more constituents of nanomatrix 616 and nanomatrix material 620, depending on the extent of interdiffusion, if any, that occurs between the dispersed particles 614 and the nanomatrix 616.

In an exemplary embodiment, the nanomatrix material 620 has a chemical composition and the particle core material 618 has a chemical composition that is different from that of nanomatrix material 620, and the differences in the chemical compositions may be configured to provide a selectable and controllable dissolution rate, including a selectable transition from a very low dissolution rate to a very rapid dissolution rate, in response to a controlled change in a property or condition of the wellbore proximate the compact 600, including a property change in a wellbore fluid that is in contact with the powder compact 600, as described herein. Nanomatrix 616 may be formed from powder particles 412 having single layer and multilayer coating layers 416. This design flexibility provides a large number of material combinations, particularly in the case of multilayer coating layers 416, that can be utilized to tailor the cellular nanomatrix 616 and composition of nanomatrix material 620 by controlling the interaction of the coating layer constituents, both within a given layer, as well as between a coating layer 416 and the particle core 414 with which it is associated or a coating layer 416 of an adjacent powder particle 412. Several exemplary embodiments that demonstrate this flexibility are provided below.

As illustrated in FIG. 8, in an exemplary embodiment, powder compact 600 is formed from powder particles 412 where the coating layer 416 comprises a single layer, and the resulting nanomatrix 616 between adjacent ones of the plurality of dispersed particles 614 comprises the single metallic coating layer 416 of one powder particle 412, a bond layer 619 and the single coating layer 416 of another one of the adjacent powder particles 412. The thickness (t) of bond layer 619 is determined by the extent of the interdiffusion between the single metallic coating layers 416, and may encompass the entire thickness of nanomatrix 616 or only a portion thereof. In one exemplary embodiment of powder compact 600 formed using a single layer powder 410, powder compact 600 may include dispersed particles 614 comprising Mg, Al, Zn or Mn, or a combination thereof, as described herein, and nanomatrix 616 may include Al, Zn, Mn, Mg, Mo, W, Cu, Fe, Si, Ca, Co, Ta, Re or Ni, or an oxide, carbide or nitride thereof, or a combination of any of the aforementioned materials, including combinations where the nanomatrix material 620 of cellular nanomatrix 616, including bond layer 619, has a chemical composition and the core material 618 of dispersed particles 614 has a chemical composition that is different than the chemical composition of nanomatrix material 616. The difference in the chemical composition of the nanomatrix material 620 and the core material 618 may be used to provide selectable and controllable dissolution in response to a change in a property of a wellbore, including a wellbore fluid, as described herein. In a further exemplary embodiment of a powder compact 600 formed from a powder 410 having a single coating layer configuration, dispersed particles 614 include Mg, Al, Zn or Mn, or a combination thereof, and the cellular nanomatrix 616 includes Al or Ni, or a combination thereof.

Figure 9:
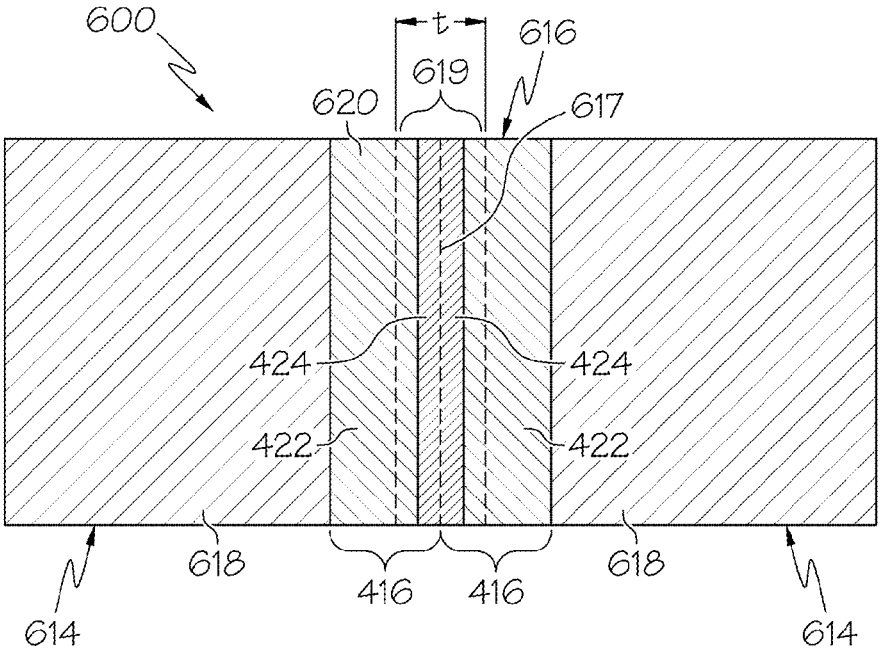
FIG. 9 is a schematic of illustration of another exemplary embodiment of the powder compact of FIG. 7 made using a powder having multilayer powder particles as it would appear taken along section 8-8.

As illustrated in FIG. 9, in another exemplary embodiment, powder compact 600 is formed from powder particles 412 where the coating layer 416 comprises a multilayer coating layer 416 having a plurality of coating layers, and the resulting nanomatrix 616 between adjacent ones of the plurality of dispersed particles 614 comprises the plurality of layers (t) comprising the coating layer 416 of one particle 412, a bond layer 619, and the plurality of layers comprising the coating layer 416 of another one of powder particles 412. In FIG. 9, this is illustrated with a two-layer metallic coating layer 416, but it will be understood that the plurality of layers of multilayer metallic coating layer 416 may include any desired number of layers. The thickness (t) of the bond layer 619 is again determined by the extent of the interdiffusion between the plurality of layers of the respective coating layers 416, and may encompass the entire thickness of nanomatrix 616 or only a portion thereof. In this embodiment, the plurality of layers comprising each coating layer 416 may be used to control interdiffusion and formation of bond layer 619 and thickness (t).

Sintered and forged powder compacts 600 that include dispersed particles 614 comprising Mg and nanomatrix 616 comprising various nanomatrix materials as described herein have demonstrated an excellent combination of mechanical strength and low density that exemplify the lightweight, high-strength materials disclosed herein. Examples of powder compacts 600 that have pure Mg dispersed particles 614 and various nanomatrices 616 formed from powders 410 having pure Mg particle cores 414 and various single and multilayer metallic coating layers 416 that include Al, Ni, W or $Al_2O_3$, or a combination thereof. These powders compacts 600 have been subjected to various mechanical and other testing, including density testing, and their dissolution and mechanical property degradation behavior has also been characterized as disclosed herein. The results indicate that these materials may be configured to provide a wide range of selectable and controllable corrosion or dissolution behavior from very low corrosion rates to extremely high corrosion rates, particularly corrosion rates that are both lower and higher than those of powder compacts that do not incorporate the cellular nanomatrix, such as a compact formed from pure Mg powder through the same compaction and sintering processes in comparison to those that include pure Mg dispersed particles in the various cellular nanomatrices described herein. These powder compacts 600 may also be configured to provide substantially enhanced properties as compared to powder compacts formed from pure Mg particles that do not include the nanoscale coatings described herein. Powder compacts 600 that include dispersed particles 614 comprising Mg and nanomatrix 616 comprising various nanomatrix materials 620 described herein have demonstrated room temperature compressive strengths of at least about 37 ksi, and have further demonstrated room temperature compressive strengths in excess of about 50 ksi, both dry and immersed in a solution of 3% KCl at 200° F. In contrast, powder compacts formed from pure Mg powders have a compressive strength of about 20 ksi or less. Strength of the nanomatrix powder metal compact 600 can be further improved by optimizing powder 410, particularly the weight percentage of the nanoscale metallic coating layers 416 that are used to form cellular nanomatrix 616. Strength of the nanomatrix powder metal compact 600 can be further improved by optimizing powder 410, particularly the weight percentage of the nanoscale metallic coating layers 416 that are used to form cellular nanomatrix 616. For example, varying the weight percentage (wt. %), i.e., thickness, of an alumina coating within a cellular nanomatrix 616 formed from coated powder particles 412 that include a multilayer ($Al/Al_2O_3/Al$) metallic coating layer 416 on pure Mg particle cores 414 provides an increase of 21% as compared to that of 0 wt % alumina.

Powder compacts 600 comprising dispersed particles 614 that include Mg and nanomatrix 616 that includes various nanomatrix materials as described herein have also demonstrated a room temperature sheer strength of at least about 20 ksi. This is in contrast with powder compacts formed from pure Mg powders which have room temperature sheer strengths of about 8 ksi.

Powder compacts 600 of the types disclosed herein are able to achieve an actual density that is substantially equal to the predetermined theoretical density of a compact material based on the composition of powder 410, including relative amounts of constituents of particle cores 414 and metallic coating layer 416, and are also described herein as being fully-dense powder compacts. Powder compacts 600 comprising dispersed particles that include Mg and nanomatrix 616 that includes various nanomatrix materials as described herein have demonstrated actual densities of about 1.738 $g/cm^3$ to about 2.50 $g/cm^3$, which are substantially equal to the predetermined theoretical densities, differing by at most 4% from the predetermined theoretical densities.

Figure 10:
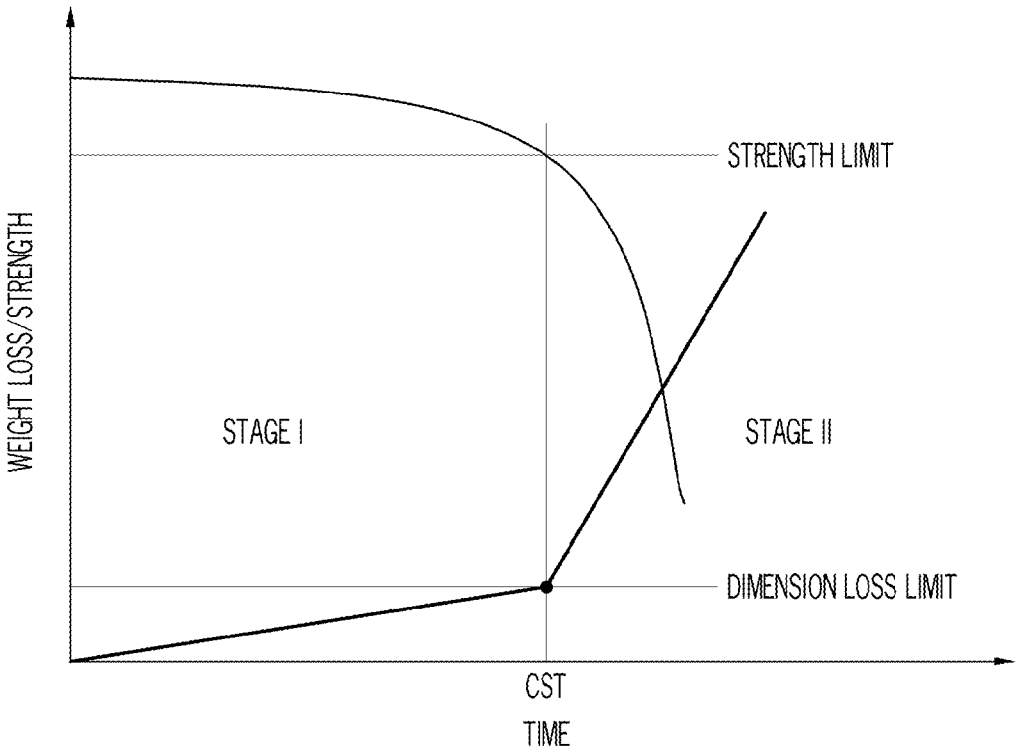
FIG. 10 is a schematic illustration of a change in a property of a powder compact as disclosed herein as a function of time and a change in condition of the powder compact environment.

Powder compacts 600 as disclosed herein may be configured to be selectively and controllably dissolvable in a wellbore fluid in response to a changed condition in a wellbore. Examples of the changed condition that may be exploited to provide selectable and controllable dissolvability include a change in temperature, change in pressure, change in flow rate, change in pH or change in chemical composition of the wellbore fluid, or a combination thereof. An example of a changed condition comprising a change in temperature includes a change in well bore fluid temperature. For example, powder compacts 600 comprising dispersed particles 614 that include Mg and cellular nanomatrix 616 that includes various nanomatrix materials as described herein have relatively low rates of corrosion in a 3% KCl solution at room temperature that range from about 0 to about 11 $mg/cm^2/hr$ as compared to relatively high rates of corrosion at 200° F. that range from about 1 to about 246 $mg/cm^2/hr$ depending on different nanoscale coating layers 416. An example of a changed condition comprising a change in chemical composition includes a change in a chloride ion concentration or pH value, or both, of the wellbore fluid. For example, powder compacts 600 comprising dispersed particles 614 that include Mg and nanomatrix 616 that includes various nanoscale coatings described herein demonstrate corrosion rates in 15% HCl that range from about 4750 $mg/cm^2/hr$ to about 7432 $mg/cm^2/hr$. Thus, selectable and controllable dissolvability in response to a changed condition in the wellbore, namely the change in the wellbore fluid chemical composition from KCl to HCl, may be used to achieve a characteristic response as illustrated graphically in FIG. 10, which illustrates that at a selected predetermined critical service time (CST) a changed condition may be imposed upon powder compact 600 as it is applied in a given application, such as a wellbore environment, that causes a controllable change in a property of powder compact 600 in response to a changed condition in the environment in which it is applied. For example, at a predetermined CST changing a wellbore fluid that is in contact with powder contact 600 from a first fluid (e.g. KCl) that provides a first corrosion rate and an associated weight loss or strength as a function of time to a second wellbore fluid (e.g., HCl) that provides a second corrosion rate and associated weight loss and strength as a function of time, wherein the corrosion rate associated with the first fluid is much less than the corrosion rate associated with the second fluid. This characteristic response to a change in wellbore fluid conditions may be used, for example, to associate the critical service time with a dimension loss limit or a minimum strength needed for a particular application, such that when a wellbore tool or component formed from powder compact 600 as disclosed herein is no longer needed in service in the wellbore (e.g., the CST) the condition in the wellbore (e.g., the chloride ion concentration of the wellbore fluid) may be changed to cause the rapid dissolution of powder compact 600 and its removal from the wellbore. In the example described above, powder compact 600 is selectably dissolvable at a rate that ranges from about 0 to about 7000 $mg/cm^2/hr$. This range of response provides, for example the ability to remove a 3 inch diameter ball formed from this material from a wellbore by altering the wellbore fluid in less than one hour. The selectable and controllable dissolvability behavior described above, coupled with the excellent strength and low density properties described herein, define a new engineered dispersed particle-nanomatrix material that is configured for contact with a fluid and configured to provide a selectable and controllable transition from one of a first strength condition to a second strength condition that is lower than a functional strength threshold, or a first weight loss amount to a second weight loss amount that is greater than a weight loss limit, as a function of time in contact with the fluid. The dispersed particle-nanomatrix composite is characteristic of the powder compacts 600 described herein and includes a cellular nanomatrix 616 of nanomatrix material 620, a plurality of dispersed particles 614 including particle core material 618 that is dispersed within the matrix. Nanomatrix 616 is characterized by a solid-state bond layer 619 which extends throughout the nanomatrix. The time in contact with the fluid described above may include the CST as described above. The CST may include a predetermined time that is desired or required to dissolve a predetermined portion of the powder compact 600 that is in contact with the fluid. The CST may also include a time corresponding to a change in the property of the engineered material or the fluid, or a combination thereof. In the case of a change of property of the engineered material, the change may include a change of a temperature of the engineered material. In the case where there is a change in the property of the fluid, the change may include the change in a fluid temperature, pressure, flow rate, chemical composition or pH or a combination thereof. Both the engineered material and the change in the property of the engineered material or the fluid, or a combination thereof, may be tailored to provide the desired CST response characteristic, including the rate of change of the particular property (e.g., weight loss, loss of strength) both prior to the CST (e.g., Stage 1) and after the CST (e.g., Stage 2), as illustrated in FIG. 10.

Without being limited by theory, powder compacts 600 are formed from coated powder particles 412 that include a particle core 414 and associated core material 418 as well as a metallic coating layer 416 and an associated metallic coating material 420 to form a substantially-continuous, three-dimensional, cellular nanomatrix 616 that includes a nanomatrix material 620 formed by sintering and the associated diffusion bonding of the respective coating layers 416 that includes a plurality of dispersed particles 614 of the particle core materials 618. This unique structure may include metastable combinations of materials that would be very difficult or impossible to form by solidification from a melt having the same relative amounts of the constituent materials. The coating layers and associated coating materials may be selected to provide selectable and controllable dissolution in a predetermined fluid environment, such as a wellbore environment, where the predetermined fluid may be a commonly used wellbore fluid that is either injected into the wellbore or extracted from the wellbore. As will be further understood from the description herein, controlled dissolution of the nanomatrix exposes the dispersed particles of the core materials. The particle core materials may also be selected to also provide selectable and controllable dissolution in the wellbore fluid. Alternately, they may also be selected to provide a particular mechanical property, such as compressive strength or sheer strength, to the powder compact 600, without necessarily providing selectable and controlled dissolution of the core materials themselves, since selectable and controlled dissolution of the nanomatrix material surrounding these particles will necessarily release them so that they are carried away by the wellbore fluid. The microstructural morphology of the substantially-continuous, cellular nanomatrix 616, which may be selected to provide a strengthening phase material, with dispersed particles 614, which may be selected to provide equiaxed dispersed particles 614, provides these powder compacts with enhanced mechanical properties, including compressive strength and sheer strength, since the resulting morphology of the nanomatrix/dispersed particles can be manipulated to provide strengthening through the processes that are akin to traditional strengthening mechanisms, such as grain size reduction, solution hardening through the use of impurity atoms, precipitation or age hardening and strength/work hardening mechanisms. The nanomatrix/dispersed particle structure tends to limit dislocation movement by virtue of the numerous particle nanomatrix interfaces, as well as interfaces between discrete layers within the nanomatrix material as described herein. This is exemplified in the fracture behavior of these materials. A powder compact 600 made using uncoated pure Mg powder and subjected to a shear stress sufficient to induce failure demonstrated intergranular fracture. In contrast, a powder compact 600 made using powder particles 412 having pure Mg powder particle cores 414 to form dispersed particles 614 and metallic coating layers 416 that includes Al to form nanomatrix 616 and subjected to a shear stress sufficient to induce failure demonstrated transgranular fracture and a substantially higher fracture stress as described herein. Because these materials have high-strength characteristics, the core material and coating material may be selected to utilize low density materials or other low density materials, such as low-density metals, ceramics, glasses or carbon, that otherwise would not provide the necessary strength characteristics for use in the desired applications, including wellbore tools and components.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A tool comprising a dissolvable body having at least one stress riser defined as an indentation in a surface of the dissolvable body having a vertex defined by a cone configured to concentrate stress thereat to accelerate structural degradation of the dissolvable body through chemical reaction under applied stress within a reactive environment, wherein the tool is a ball.

2. A tool comprising a dissolvable body having a shell configured to provide structural integrity to the dissolvable body and having at least one stress riser defined as an indentation in a surface of the dissolvable body having a vertex defined by a cone configured to concentrate stress thereat to accelerate structural degradation of the dissolvable body through chemical reaction under applied stress within a reactive environment wherein the shell surrounds a fluidized core.

3. The tool of claim 2, wherein the shell is hollow.

4. A dissolvable tool comprising a body having at least one stress riser configured to concentrate stress thereat to accelerate structural degradation of the body through chemical reaction under applied stress within a reactive environment, wherein at least a portion of the body is made of a powder metal compact, the compact comprising:

a substantially-continuous, cellular nanomatrix comprising a nanomatrix material;

a plurality of dispersed particles comprising a particle core material that comprises Mg, Al, Zn or Mn, or a combination thereof, dispersed in the cellular nanomatrix; and a solid-state bond layer extending throughout the cellular nanomatrix between the dispersed particles.

5. The tool of claim 4 wherein the at least one stress riser is defined as a indentation in a surface of the dissolvable body having a vertex defined by a cone configured to concentrate stress thereat to accelerate structural degradation of the dissolvable body through chemical reaction under applied stress within a reactive environment.

6. The tool of claim 5, wherein foreign matter is embedded in the dissolvable body and the foreign matter is at least partially exposed to a surface of the dissolvable body.

7. The tool of claim 5, wherein the at least one stress riser is an indentation in a surface of the dissolvable body having a vertex at intersection of at least two surfaces.

8. The tool of claim 5, wherein the applied stress is due to changes in pressure.

9. The tool of claim 5, wherein the applied stress is due to pressure differential applied across a portion of the dissolvable body.

10. The tool of claim 5, wherein the applied stress is due to changes in temperature.

11. The tool of claim 5, wherein the applied stress is due to hydrostatic pressure.

12. The tool of claim 4 wherein the indentation includes a vertex.

13. The tool of claim 12, wherein the vertex is an intersection of at least two surfaces.

14. The tool of claim 12, wherein the vertex is defined by a cone.

15. The dissolvable tool of claim 4, wherein the dispersed particles comprise Mg—Zn, Mg—Zn, Mg—Al, Mg—Mn, Mg—Zn—Y, Mg—Al—Si or Mg—Al—Zn.

16. The dissolvable tool of claim 4, wherein the dispersed particles have an average particle size of about 5 μm to about 300 μm.

17. The dissolvable tool of claim 4, wherein the dispersed particles have an equiaxed particle shape.

18. The dissolvable tool of claim 4, wherein the nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials, and wherein the nanomatrix material has a chemical composition and the particle core material has a chemical composition that is different than the chemical composition of the nanomatrix material.

19. The dissolvable tool of claim 4, wherein the cellular nanomatrix has an average thickness of about 50 nm to about 5000 nm.

* * * * *